US005251789A

United States Patent [19]

Jeans

[11] Patent Number: 5,251,789

[45] Date of Patent: Oct. 12, 1993

[54] IN-HOME DRINK DISPENSER

[75] Inventor: Edward L. Jeans, Lydart, Wales

[73] Assignee: Cadbury Schweppes, PLC, London, England

[21] Appl. No.: 890,428

[22] Filed: May 29, 1992

Related U.S. Application Data

[60] Division of Ser. No. 511,941, Apr. 16, 1990, Pat. No. 5,118,010, which is a continuation of Ser. No. 257,128, Oct. 7, 1988, abandoned, which is a continuation of Ser. No. 799,911, Nov. 20, 1985, abandoned.

[51] Int. Cl.[5] ..... B67D 5/56

[52] U.S. Cl. ..... 222/129.1; 222/399; 137/503; 137/170.1; 251/126; 261/DIG. 7

[58] Field of Search ..... 222/129.1–129.4, 222/394, 396, 397, 399; 261/DIG. 7; 251/126; 137/503, 540, 12.5, 170.1, 170.2

[56] References Cited

U.S. PATENT DOCUMENTS

| | | | |
|---|---|---|---|
| 2,132,011 | 10/1938 | Bennett et al. | 261/DIG. 7 X |
| 3,224,641 | 12/1965 | Morgan | 222/129.1 |
| 3,232,489 | 2/1966 | Buffington | 222/129.1 X |
| 3,240,395 | 3/1966 | Carver | 222/129.1 |
| 3,307,751 | 3/1967 | Kraft | 137/170.1 X |
| 3,469,745 | 9/1969 | Serio, Jr. et al. | 222/399 |
| 3,561,649 | 2/1971 | Wilson | 222/399 |
| 3,578,214 | 5/1971 | Iannelli | 222/129.1 |
| 3,813,010 | 5/1974 | Hassell et al. | 222/129.1 |
| 4,031,913 | 6/1977 | Apellaniz | 137/170.1 |
| 4,493,441 | 1/1985 | Sedam et al. | 222/129.1 |
| 5,118,010 | 6/1992 | Jeans | 222/129.1 X |
| 5,165,575 | 11/1992 | Scott | 222/129.1 |

*Primary Examiner*—Kevin P. Shaver
*Attorney, Agent, or Firm*—Kenyon & Kenyon

[57] ABSTRACT

A post mix in-home carbonated drink dispenser has a novel expansion chamber and an anti-surge valve. The expansion chamber is a gradually expanding chamber which reduces carbonation loss as the carbonated liquid passes from the carbonator to the point where the liquid is discharged. The anti-surge valve, which is provided between the carbonator and the expansion chamber is designed to reduce the spitting and sputtering often experienced on start-up of a drink dispenser. The dispensing valve for carbonated water is part of the carbonator and not the dispensing head. This means that no carbonated water exists outside the carbonator. In addition, the dispenser is provided with a thin gas cylinder connecting probe which provides for a simple and easy to use $CO_2$ cylinder connection.

47 Claims, 20 Drawing Sheets

IN-HOME DRINK DISPENSER

This is a division of application Ser. No. 07/511,941 filed Apr. 16, 1990, now U.S. Pat. No. 5,188,010, which is a continuation of application Ser. No. 07/257,128 filed Oct. 7, 1988, now abandoned, which in turn is a continuation of application Ser. No. 06/799,911 filed Nov. 20, 1985, now abandoned.

This invention relates to apparatus for dispensing beverages in general, and more particularly to an improved in-home drink dispenser, particularly useful in dispensing carbonated drinks made of a mixture of a concentrate (e.g., a syrup) and a diluent (e.g., carbonated water).

BACKGROUND OF THE INVENTION

In prior U.S. Pat. Nos. 4,408,701; 4,328,909, 4,555,771, 4,363,424, 4,523,697, 4,520,950, 4,570,830, 4,564,483 and 4,664,292, various aspects of an in-home drink dispenser are described. The dispensers disclosed therein have been found to work quite well, particularly the embodiments utilizing gravity feed of the concentrate, for example, the system disclosed in U.S. Pat. No. 4,570,830. There are, however, certain problems with these previous systems. One problem is in maintaining the desired degree of carbonation in the drink. Another problem encountered is the spitting or sputtering which occurs upon the initial opening of the dispense valve due to a build up of pressure.

The previously disclosed system included passages for the diluent in a manifold. There was an area between the connection to a carbonator tank and the dispensing valve where diluent was maintained when the carbonator was disconnected from the system. If the diluent, e.g., carbonated water was left in these passages for a long period of time, it would, of course, warm up and lose its pressurization and its carbonation when dispensed. Although this is not a major problem, it was felt desirable to avoid this.

In an in-home drink dispenser, it is, of course, important to know how much carbonated water is left and also how much carbon dioxide is left. Knowing when one is about to run out of carbon dioxide is of great importance, particularly where a cylinder is not immediately on hand. The carbonator can be refilled with water and i.e., however, if one runs out of carbon dioxide, at a time when the supplier is not open for business, it may be necessary to wait, possibly over a weekend, to get new cylinder. Thus, the need for an indication of this level is particularly important. Furthermore, in regard to the carbon dioxide cylinders, since the cylinders are being handled by people not used to such, there is a need to take measures to protect the cylinders and to provide for ease of use and insertion and removal from the drink dispenser.

SUMMARY OF THE INVENTION

The present invention provides a particularly attractive in-home drink dispenser which is easy for the consumer to use and which provides a drink which has a proper and repeatable strength and carbonation.

A number of features are incorporated into the drink dispenser of the present invention which give it these qualities. In the first instance, to avoid loss of carbonation when dispensing, a novel expansion chamber is provided. This expansion chamber, which is kept cold, is a gradually enlarging chamber which permits a gradual expansion and lowering of pressure from the pressure inside the carbonator tank of approximately 50 psi to atmospheric pressure at the point where the diluent is discharged from the machine. This, in combination with an arrangement in which it is insured that the glass being filled is positioned so that discharge takes place tangentially to the inside surface of the glass, leads to maintaining the high level of carbonation which is achieved within the carbonator.

Spitting and sputtering is avoided on initial startup of the system by providing in the system, preceding the expansion chamber, an anti-surge valve. This anti-surge valve acts to reduce the pressure in the expansion chamber to a level which will allow dispensing, upon the initial opening of the dispensing valve without spitting or sputtering. In the illustrated embodiment, the expansion chamber and anti-surge valve are installed within the carbonator tank.

Furthermore, the dispensing valve, itself, i.e., the valve that opens to permit flow of the carbonated water out into the glass, is formed as part of the carbonator rather than part of the dispense head. This means that carbonated water no longer exists outside the carbonator. The carbonator includes a connector block by means of which it is coupled to a source of carbon dioxide for carbonating, and within this connecting block there is disposed a shuttle valve which acts as a dispensing valve. The shuttle valve has a radial inlet adapted to be coupled to the outlet from the carbonator tank and an axial outlet.

A dispensing spout is held within a cradle within the dispense head and is in an abutting relationship with the shuttle valve with a seal therebetween, the shuttle valve normally being biased to a closed position. As in the previous dispenser, the concentrate, e.g., syrup is dispensed directly from the syrup package by rotating the cap of the package to open a valve formed therein. This rotation is accomplished by means of a pneumatic actuator which rotates an annular disk, which engages the cap. In accordance with the present invention, this actuator is also coupled to the cradle holding the spout. When the pneumatic actuator is operated, it moves the cradle, causing the shuttle valve to move inwardly to an open position to permit dispensing of the carbonated water through the spout. Guide means are provided for guiding the connecting block of the carbonator and insuring proper alignment of both the gas connection, and the water outlet connection which operates the shuttle valve. Included is a locking apparatus to lock the carbonator in place when in proper alignment. As with previous embodiments, the carbonator simply slides in and out of position to allow ease of removal and insertion when the carbonator needs to be refilled.

As with previous systems, it is necessary to connect a carbon dioxide cylinder to the system. Again, this is done with a connection which, when the connection is made, opens a valve to allow a flow of carbon dioxide out of the gas cylinder. In the connections disclosed in the aforementioned applications, a connecting means which provided a relatively high mechanical advantage was provided. This was thought necessary at the time because of the high pressure acting on the probe entering the cylinder, this pressure being too high for the average person to operate against when inserting the cylinder. This, of course, made insertion of the cylinder more difficult. However, in accordance with the present invention, a very thin probe is utilized. Because the probe is so thin, the area on which the high pressure acts is materially reduced and the force generated is not beyond that which the average person can act against. Thus, a simple connection with a fitting containing the probe which also has pins which fit into appropriate slots on a member secured to the top of the cylinder is utilized. In the illustrated embodiment, the gas tank is suspended from the fitting containing the probe, the fitting also containing a pressure regulator. By so suspending the gas cylinder, it is possible to measure its weight by providing an upward bias to the probe fitting, using suitable springs.

In accordance with the present invention, the fitting to which the gas cylinder i attached is supported rotatably within a hood, the hood forming a lever which is biased upwardly. The hood rotates on a shaft supported in a bracket which is attached to a wall of the dispenser. Springs act between the bracket and the hood to bias it upwardly. A mechanism, including a planar member, which is guided in a curved slot, maintains the probe vertical so that in any position the user can easily insert a gas cylinder onto the probe without difficulty. The planar member which is guided and which maintains the pin vertical is also provided with indicators visible through a window to indicate the degree of the fullness of the cylinder. A full cylinder will act against the spring and pull the hood all the way down. As the cylinder is used up, the hood will begin to move upwardly until, when the cylinder is completely empty, the hood will be fully up. In accordance with the present invention, the spring is adapted to begin moving the gas cylinder upward only over the last part of the supply, e.g., the last ten percent. Thus, as soon as movement starts the user knows that he is getting near the end of his supply.

The cylindrical member which engages the probe fitting is formed with a pair of arms. The arms are aligned with axial slots which are used for engaging pins positioned on the probe fitting when locking the two fittings together. By aligning the arms with the axial slots, the user is given a guide and knows exactly how to line up the gas cylinder to insert it onto the probe fitting. Preferably, on the hood, there are alignment markings and an arrow, indicating to the user the direction in which to rotate the handles or arms so as to lock the gas cylinder in place. In the illustrated embodiment, there are holes at the ends of the arms through which a finger can be inserted to hold the gas cylinder.

Also, in the preferred embodiment, a cover is placed over this fitting for decorative and protective purposes. The cover has a tear-away tab on the top to allow access to the cylindrical member and fitting when attaching to the probe fitting. The tab cover, however, provides protection during shipping and remains in place until the cylinder is to be used.

DETAILED DESCRIPTION OF THE INVENTION

Figure 1:
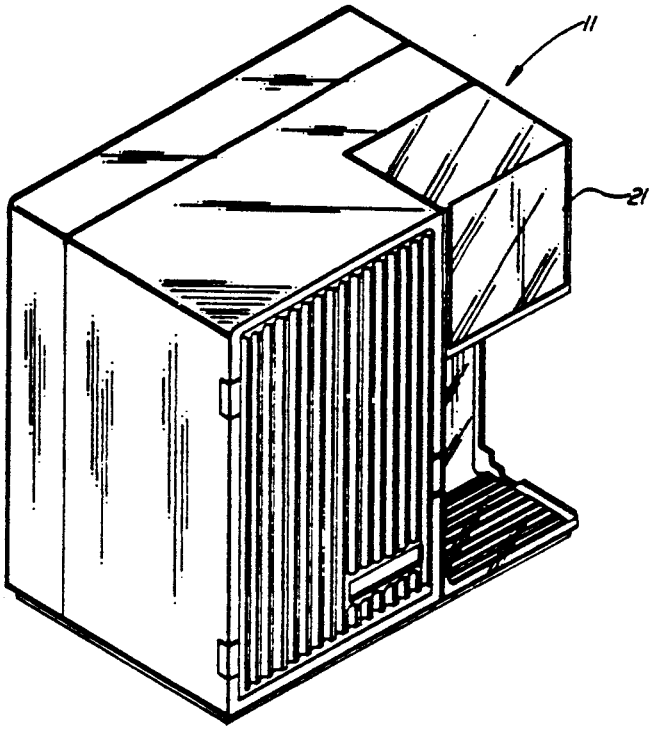
FIG. 1 is a perspective view of the in-home drink dispenser of the present invention.
Figure 2:
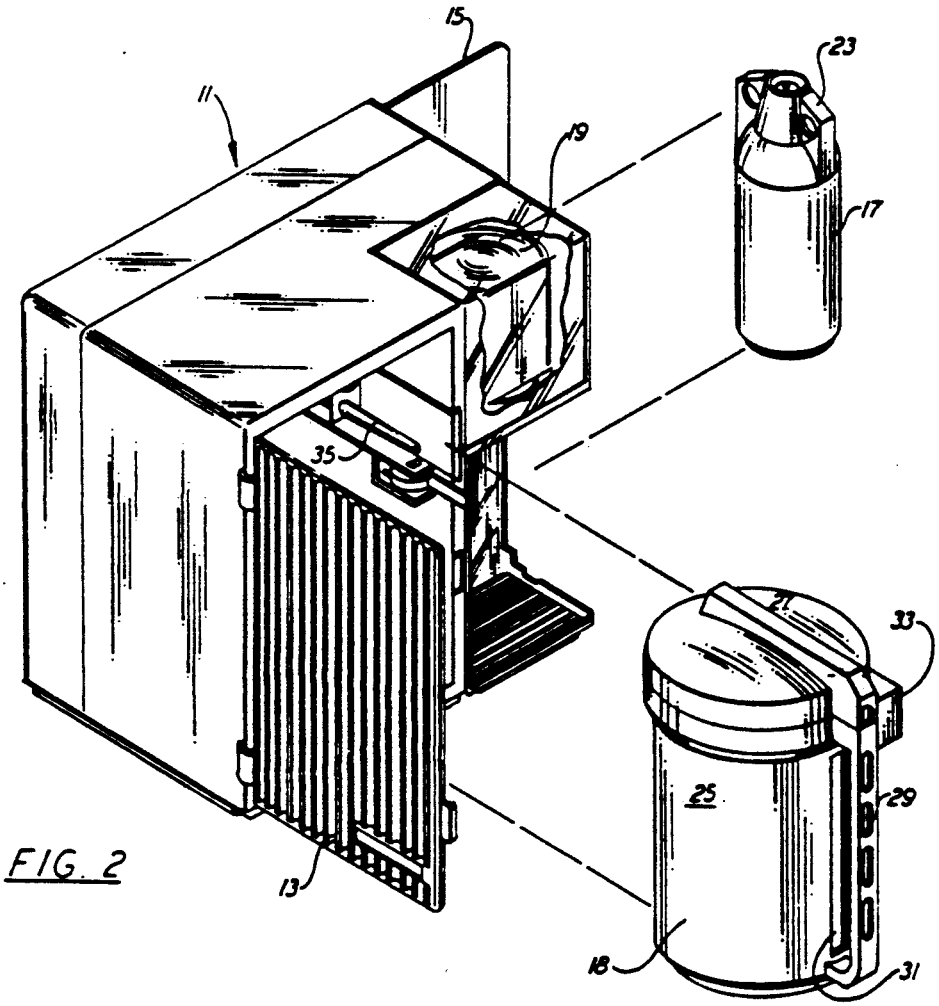
FIG. 2 is a similar view showing the door to the carbonator compartment and $CO_2$ compartment opened.

FIGS. 1 and 2 are perspective views of the improved in-home drink dispenser of the present invention. FIG. 1 shows the drink dispenser 11 with its doors closed. FIG. 2 shows the dispenser 11 with its carbonator door 13 and $CO_2$ compartment door 15 opened, and the $CO_2$ cartridge 17 and carbonator tank 18 removed. Also visible in FIG. 2 is the syrup cartridge 19. The syrup cartridge 19 is enclosed by a clear or smokey plastic enclosure 21 to finish off the outward appearance of the dispenser. The $CO_2$ cylinder 17 has a cover 23 for ease in handling and also for mounting into the dispenser in a manner to be described below. The carbonator 18 has an LCD liquid level gauge 31 and a carbonator connecting assembly 33. The connecting assembly 33 is adapted to mate with an alignment pin 35 within the compartment behind door 13. Below the pin 35 is a locking mechanism 37 for locking the carbonator in place once it is inserted.

Figure 3:
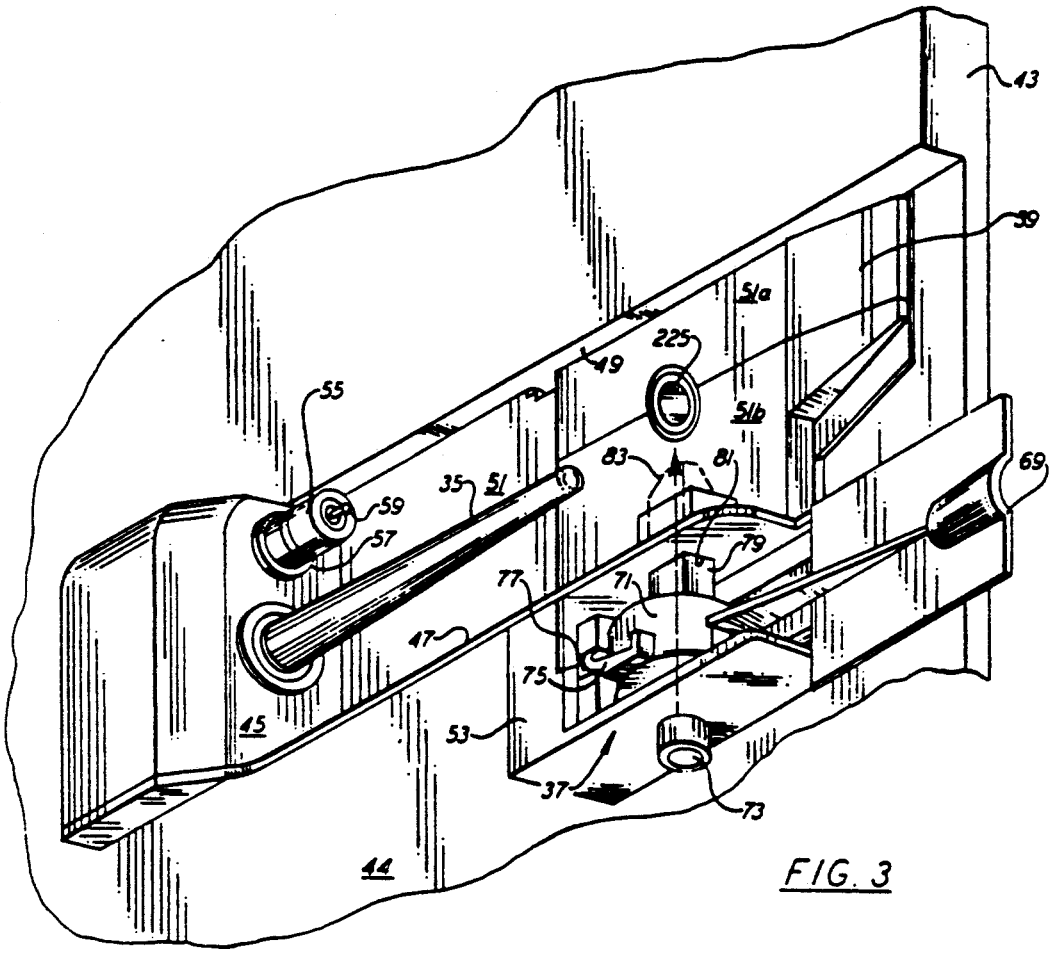
FIGS. 3 and 4 are drawings illustrate the mating mounting assemblies for the drink dispenser carbonator.
Figure 4:
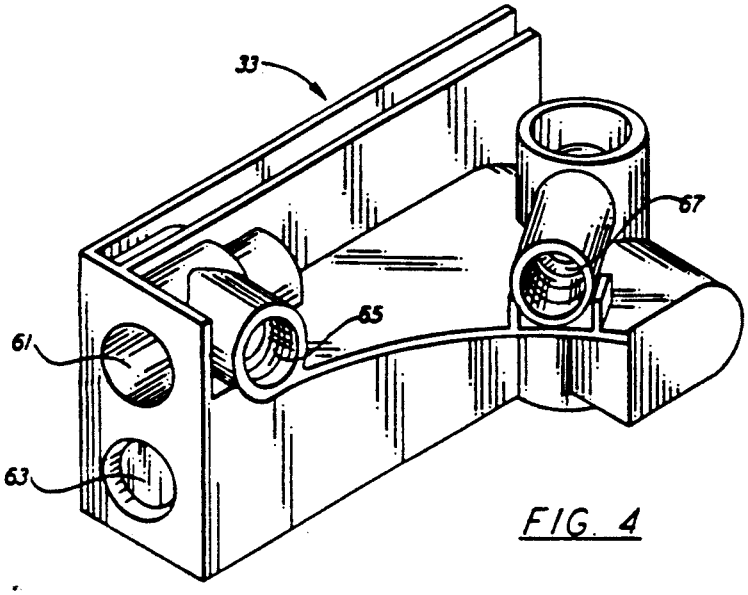
Figure 9:
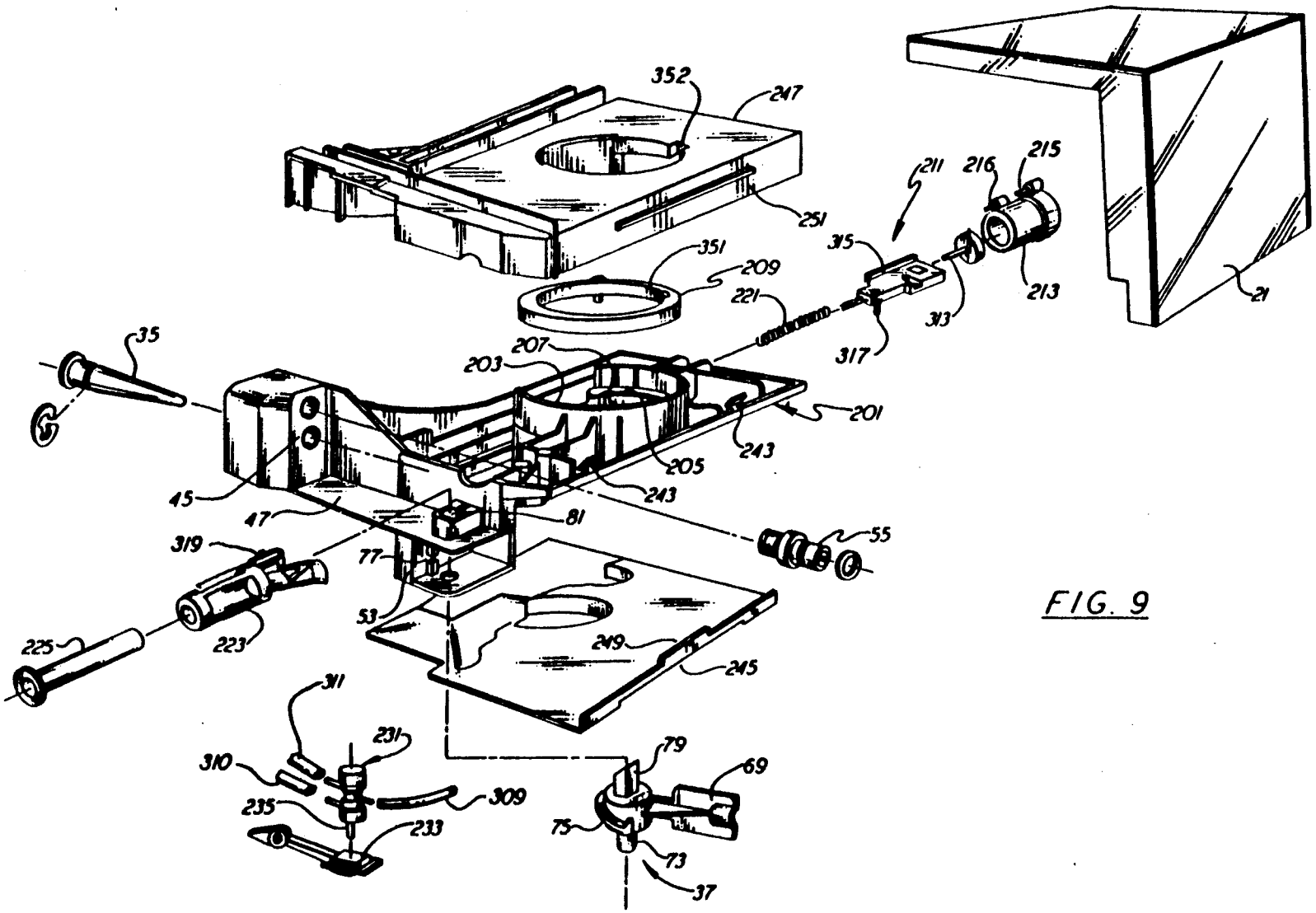
FIG. 9 is an exploded view of the dispensing assembly and dispensing head of the drink dispenser of the present invention.

FIGS. 3 and 4 show in more detail the carbonator connecting assembly 33 and pin 35 along with the locking assembly 37. The pin 35 and locking mechanism 37 are contained within a molded base member 39 which is mounted between upper wall 43 which abutts the top of member 39 and lower wall 44 which extends below member 39. Walls 43 and 44 may be separate members or may be joined along one end in which case the wall structure will fit around base member 39 of the carbonator compartment. Member 39 has a rear wall 45 perpendicular thereto from which pin 35 extends. Member 39 also has a bottom wall 47 and a side wall 51. The side wall 51 is actually the face of the actuator compartment depicted in FIG. 9. As can be seen in FIG. 9, wall 51 may split into two sections 51*a* and 51*b*. The locking mechanism 37 is installed in a recess formed by an L-shaped part 53 extending down from the bottom wall 47. Also extending out from the rear wall 45 is a tubular fitting 55 containing an O-ring seal 57. Seen extending from the end of the fitting 55 is a pin 59 which comprises the tip of a Schrader type valve mechanism which in the position shown is closed but which when then tip 59 is pushed in will be opened. This tubular fitting is coupled to the carbon dioxide supply cylinder through an appropriate pressure reducing valve to supply carbon dioxide to the carbonator 18 for carbonating the water contained therein. The valve 55 mates with a cylindrical fitting 61 on the carbonator connecting assembly 33 seen in FIG. 4. The pin 35 fits into an appropriately tappered bore 63 formed in carbonator connecting assembly 33. Also seen on the carbonator connecting assembly 33 is the outlet 65 for the carbon dioxide leading into the carbonator 18 in a manner which will be seen in more detail below. The water which is carbonated leaves the carbonator and enters an inlet 67 in the carbonator connecting assembly 33 from which it is conducted to an outlet spout which engages the carbonator connecting assembly 33 in a manner to be described in detail below.

Returning to FIG. 3, the locking mechanism comprises a handle 69 mounted to a cylindrical member 71 having a shaft 73 extending through the base of the L-shaped member 53. In this manner, the handle 69 and cylindrical member 71 are mounted for rotation about the axis of the shaft 73. Formed in the surface of the cylindrical member 71 is a cam 75. Cam 75 engages a slot 77 in the rear wall of the L-shaped portion 53. Extending upwardly from the cylindrical member is a stop member 79. The stop extends through an appropriate opening 81 in the bottom wall 47 of the member 39. The cam 75 is formed such that rotation of the handle 69 in a clockwise direction will result in the stop member 79 being moved in the direction of arrow 83 to the position shown in dotted lines. In that position, it engages the rear surface of the carbonator connecting assembly 33 to lock the carbonator in place and prevent the pressure present at the fitting 55 from blowing the carbonator outwardly.

Figure 5:
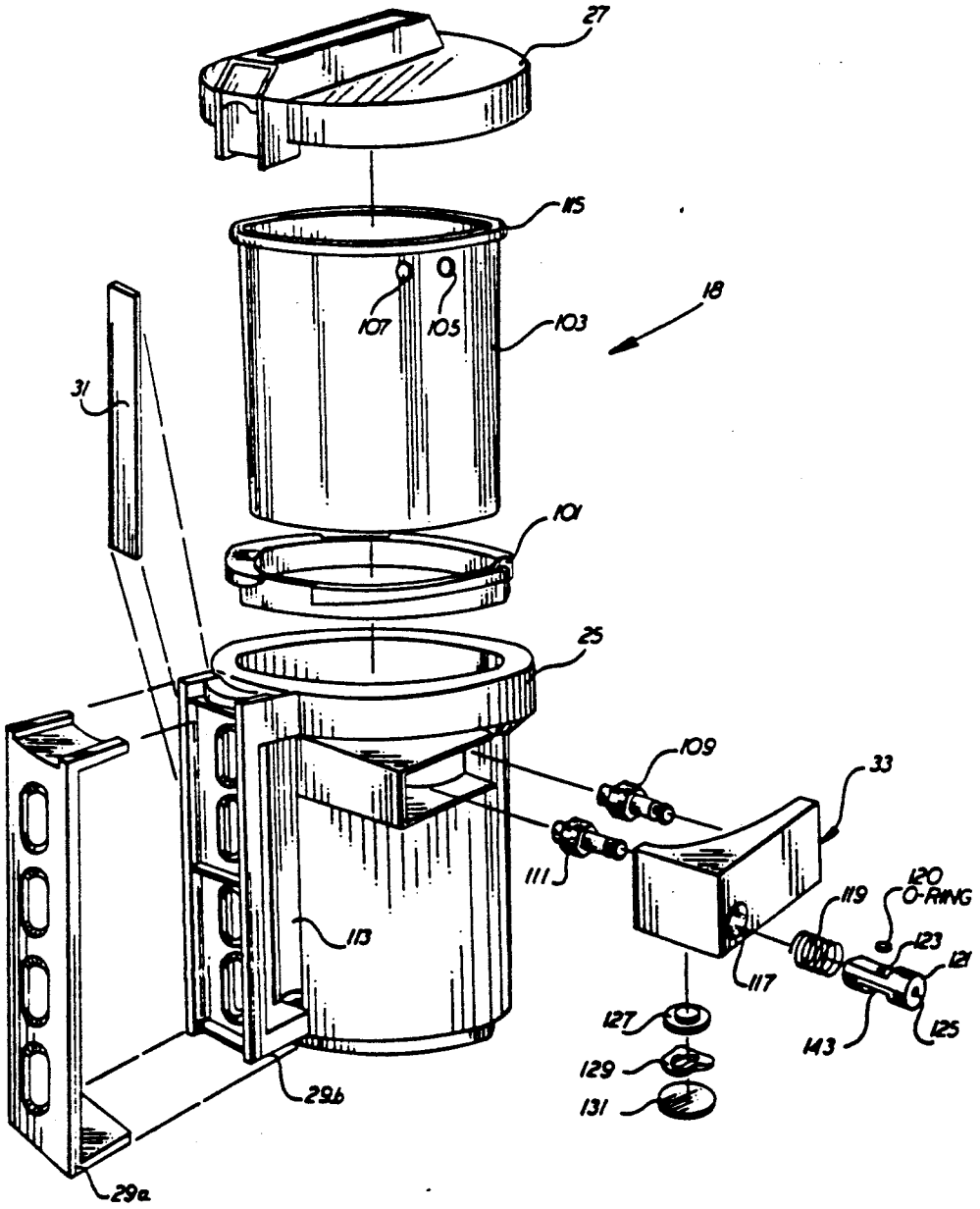
FIG. 5 is an exploded view of the carbonator and mounting assembly.

FIG. 5 is an exploded view of the carbonator 18 and the carbonator connecting assembly 33. The outer body 25 of the carbonator is made of molded plastic. Inserted into the top of body 25 is a molded plastic ring 101. Into the plastic ring 101 a stainless steel carbonator tank 103 is inserted. The tank 103 contains holes 105 and 107. When in place, these holes receive fitting 109 and 111. The fittings 109 and 111 are, respectively, the carbon dioxide inlet and the carbonated water outlet. They, respectively, are inserted into the openings 65 and 67 of the carbonator connecting assembly 33 seen in FIG. 4.

The carbonator 18 is provided with a handle made up of a portion 29*b* molded into the body 25 and another portion 29*a* inserted thereover. A liquid crystal strip 31 containing an adhesive backing is attached to the tank 103 through an opening 113 provided in the outer case 25 behind handle portion 29*b*.

The liquid crystal strip 31 responds to temperatures close to 0° C., having one color for temperatures above and another for temperatures below. The handle portions 29*a* and 29*b* are provided with opening so the strip 31 may be viewed therethrough. The carbonater is normally filled with water and ice. Thus, strip 31 gives an indication of water level in the tank.

The ring 101 contains threads to engage the lid 27. Thus, the lip 115 of the tank is trapped between the mounting ring 101 and the lid 27 to obtain a good seal. The carbonated water outlet opening bore 117 can be seen on the front of the carbonator connecting assembly 33. Into bore 117 is inserted a shuttle valve assembly. At the base of the bore 117, which is in communication with the inlet 67 seen in FIG. 4, is inserted a biasing spring 119. Next inserted is an O-ring seal 120 and a shuttle member 121. The shuttle member 121 has an inlet port 123 and an outlet port 125. From the bottom of the carbonator connecting assembly 33 a guide and stop member 127 for the shuttle member 121, a biasing spring 129 and a retaining disk 131 are inserted.

Figure 6:
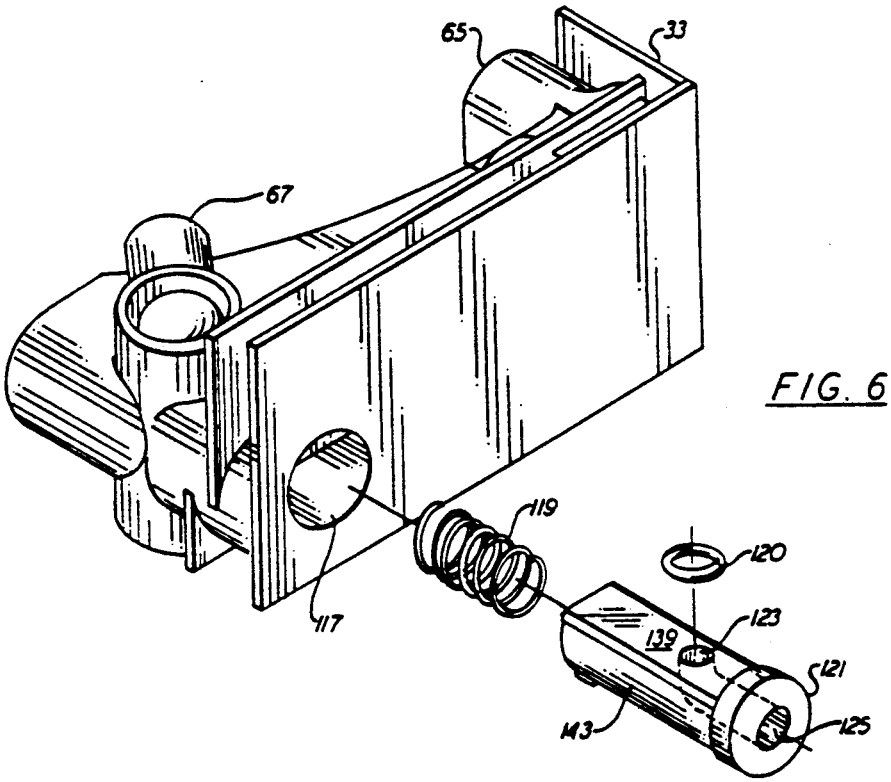
FIG. 6 is an exploded of the mounting assembly in larger scale.
Figure 7:
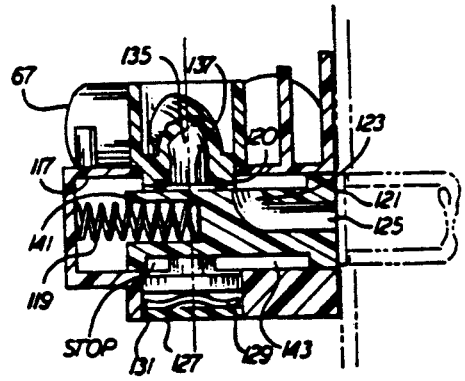
FIG. 7 is a cross section through a portion of the mounting assembly containing a bore for the shuttle.
Figure 8:
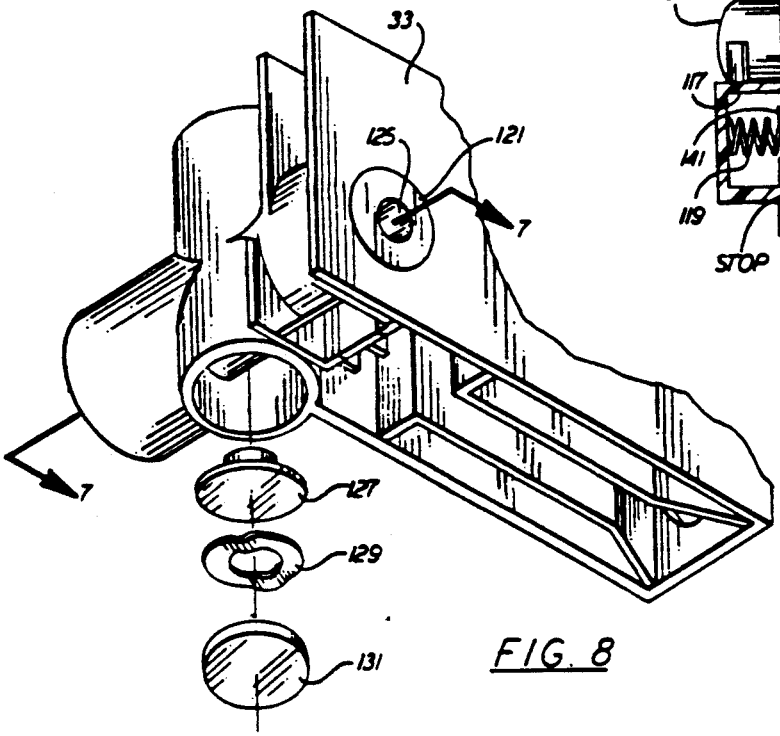
FIG. 8 is an exploded view of the portion of the mounting assembly containing the cross-section of FIG. 7.

This assembly can be seen in more detail in FIGS. 6, 7 and 8. FIG. 6 is an exploded view of the carbonator connecting assembly 33 in larger scale, showing in more detail the shuttle member 121 and O-ring seal 120. FIG. 7 is a cross section through the portion of the carbonator connecting assembly 33 containing the bore 117. As can be seen, the inlet 67 from the carbonator couples to a passage 135 terminating in an outlet opening 137. The outlet opening 137 is surrounded by the O-ring 120. The flat top portion 139 of the shuttle member 121 slides against this O-ring. In the position shown in FIG. 7, a seal is formed. There is no connection to the inlet 23 in the shuttle member 121 and the O-ring seal 120 prevents escape of any carbonated water. The spring 119, in this position, is biasing the shuttle member 121 in an outward direction up against the stop formed by the stop member 127.

As illustrated, stop member 127 is biased upwardly by spring 129, held in place by the disk 131. These parts are shown in exploded view in FIG. 8. As illustrated in the cross section of FIG. 7, the shuttle member 121 has a cylindrical recess 141 in its rear portion into which the spring 119 is inserted. The spring acts between this point and the rear wall of the bore 117. To provide the necessary stops, the bottom of the shuttle member 121 has formed therein a slot 143. When the shuttle member 121 is pushed inwardly against the biasing force of spring 119, in a manner to be described more fully below, the opening 123 is moved to a position where it is aligned with the outlet 137. The outlet 137 and inlet 123 are sealed by the O-ring seal 120. Carbonated water can then flow out of the outlet 125 to the dispensing apparatus which will be described in detail below.

FIG. 9 is an exploded view of the dispensing assembly of the drink dispenser of the present invention. It includes a base portion 201 of molded plastic. The base portion between walls 43 and 44 of FIG. 3 and forms the bottom wall 47, rear wall 45 and a portion of side wall 51 previously described. In addition, the L-shaped portion 53 is integrally molded in this base. Thus, the locking mechanism 37 is again illustrated as are the pin 35 and tubular fitting 55.

Formed in the base 201 is an annular wall 203 having an annular base 205 with an opening 207 therein. A rotatable annular disk 209 is inserted into the opening so formed. This disk 209 is adapted to engage a valving mechanism built into the syrup package in a manner to be described more fully below.

The base 201 also receives a pneumatic actuator 211 which includes a cylinder assembly 213 having an inlet 215 for receiving carbon dioxide to actuate it, a piston 217 which is inserted into the cylinder 213, a slide member 315 for operating the rotatable disk 209 and a biasing return spring 221. In a preferred embodiment a second inlet 216 in cylinder 213 via tube 310 may be used in addition to or in place of spring 221 to return the piston to the unoperated position. Also forming part of this actuating mechanism is an actuator for opening the carbonator valving mechanism described in connection with FIGS. 6–8. This includes a cradle 223 of molded plastic and an insert 225 which forms the carbonated water outlet (i.e., a spout). The cradle and insert engage with the shuttle member 121 of FIGS. 6–8 in a manner to be described more fully below. The cradle 223 is coupled to the slide member 315 by a pin 317 which is inserted into slot 319 formed in cradle 223 such that the carbonator water valve is operated at the same time as the disk 209 is operated to open the valve in the syrup package so that carbonated water and syrup are simultaneously dispensed.

Also illustrated is a spool valve 231 and an actuating mechanism 233 for the spool valve. Actuating mechanism 233 comprises a hinged arm which acts against the stem 235 on the spool valve to cause carbon dioxide supplied over a line 309 to the valve to be coupled over a line 311 to the inlet 215 of the cylinder 213 to operate the actuating mechanism. The pneumatic actuator 211, rotatable disk 209, and cradle 223 are retained in position by a cover 247 which is placed over the base 201. The base 201 is formed with clips 243 molded into it so that the cover 247 will snap into place retaining the various parts in their proper places. Alternately, the base 201 and cover 247 may be fastened together with screw fasteners. An additional bottom cover 245 may also provided for decorative and sanitary purposes.

Figure 10:
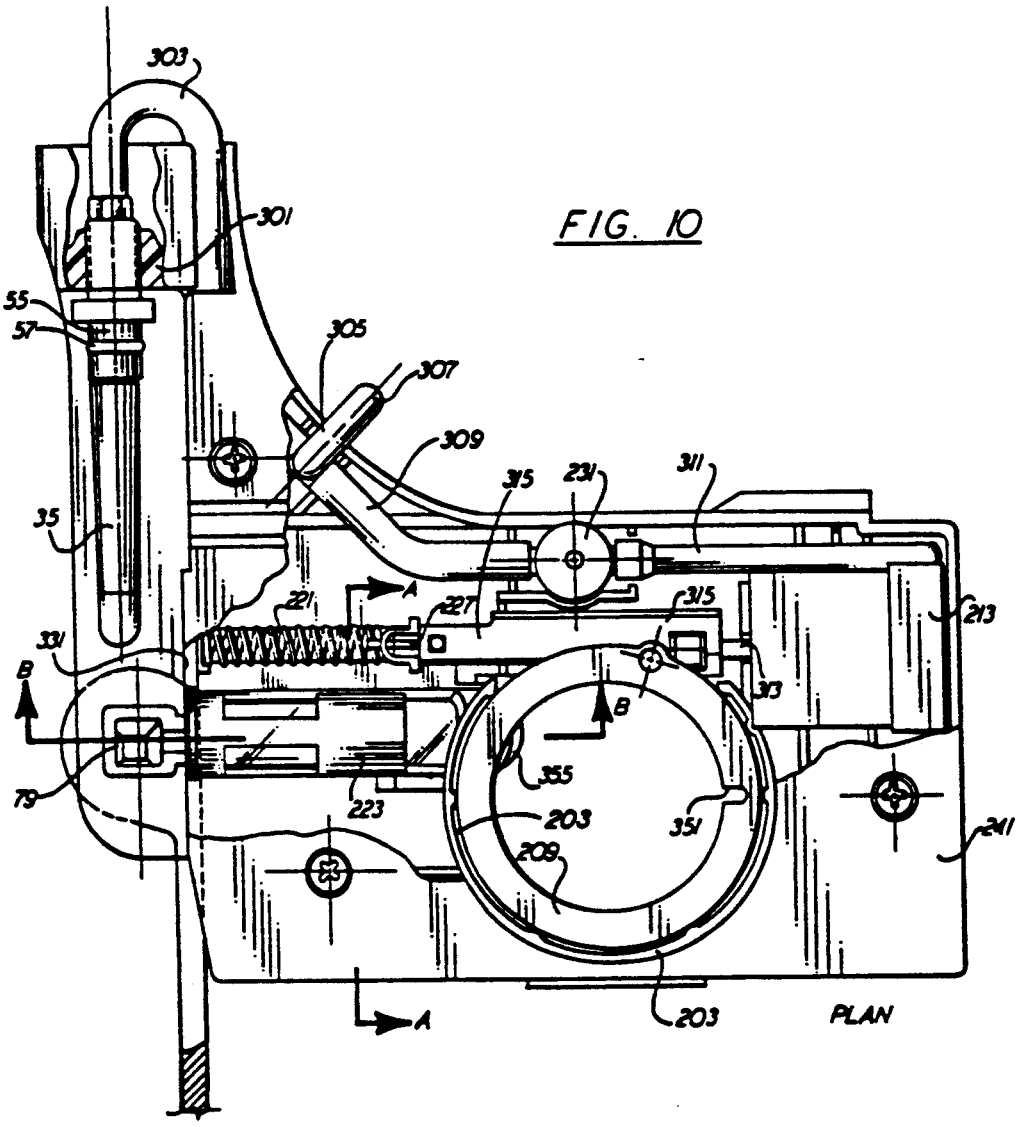
FIG. 10 is a partially cutaway plan view of the dispenser assembly.

FIG. 10 is a partially cut-away plan view of the dispenser assembly. At the left of the Figure, the alignment pin 35 is visible as is the fitting 55 with O-ring 57. As illustrated, this fitting 55 is threaded into a portion 301 formed in the base. Coupled to the end of fitting 55 is a supply line 303 which extends to a T-fitting 305. Gas from the cylinder 17 is supplied to the T-fitting over line 307. The second branch 309 of the T-fitting goes to the spool valve 231, the outlet of which, via line 311, is coupled to the inlet of the cylinder 213. A piston rod 313 which forms a portion of piston 217 is visible in this figure.

Figure 11:
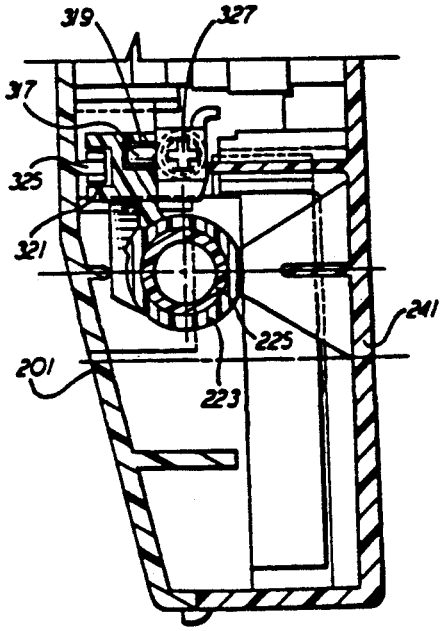
FIG. 11 is a cross section through the dispensing head.
Figures 12, 13:
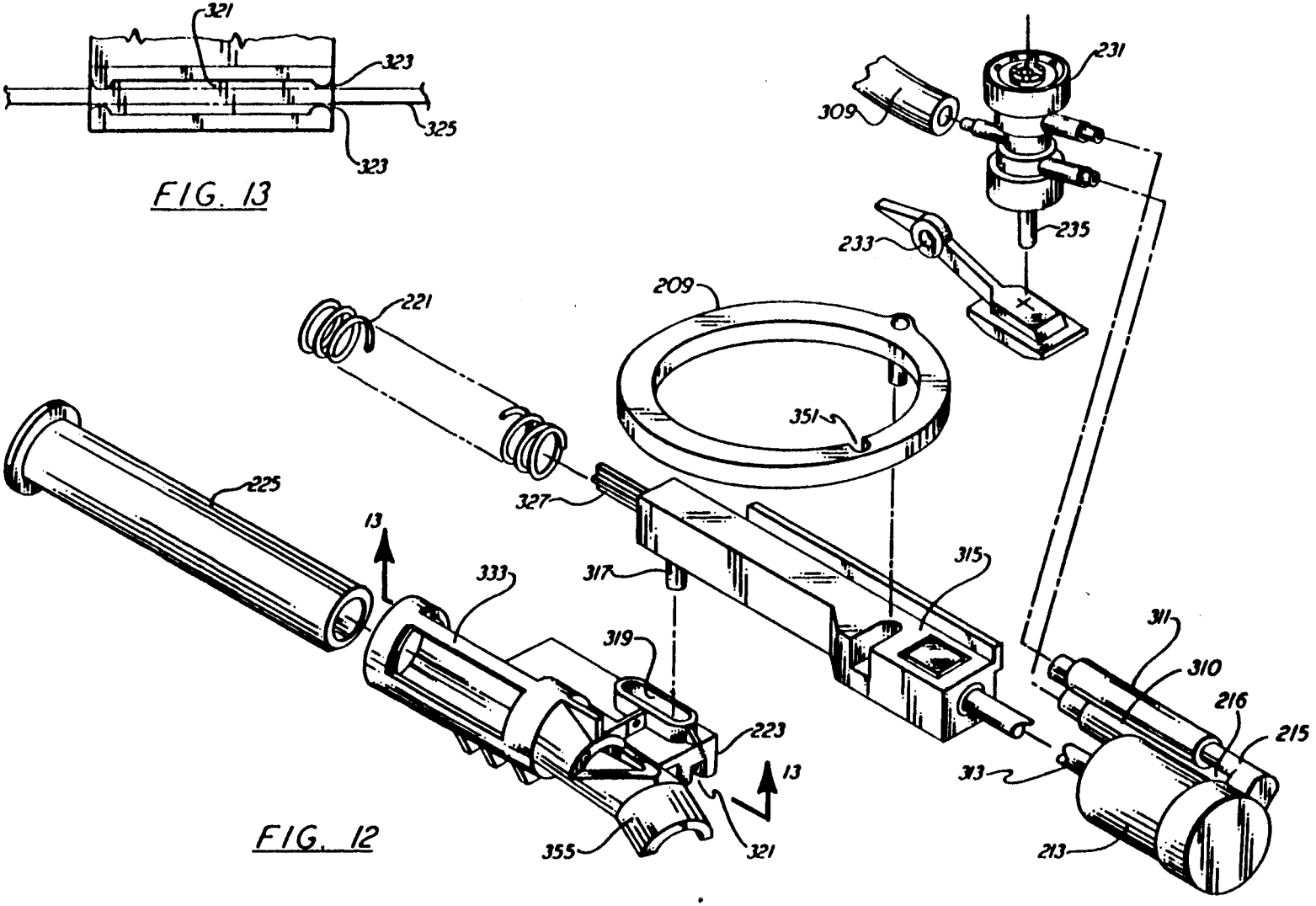
FIG. 12 is an exploded view of the actuating arrangement of the dispense head.
FIG. 13 is a bottom view of a portion of the dispense head showing the manner in which the cradle is guided.

Referring to FIG. 12, which is an exploded view of the actuator arrangement. The actuator 233 which acts against the stem 235 of the spool valve 231 is shown as are the tubes 309, 310 and 311; tubes 310 and 311 connecting to the cylinder 213. As illustrated, the piston rod 313 is coupled to a slide member 315. The slide member 315 has a downwardly extending pin 317 which engages a slot 319 in cradle 223. Cradle 223 also contains a slot 321 in its bottom, better seen in the bottom view of FIG. 13. The slot 321 is also visible in FIG. 11, which is a cross section through the dispensing unit including cradle 223. As illustrated, slot 321 is placed over a rail 325 and rides thereon. At each end of slot 321 are oppposed half cylindrical parts 323 which engage rail 325 to guide cradle 223 and reduce friction.

At the end of the slide member 315 is a cross-shaped projection 327 over which spring 221 fits. As can be seen from FIG. 10, spring 221 abuts against a wall 331. It biases the slide member 315 to the right thereby biasing the piston within cylinder 213 in the same direction. It also biases the cradle 223 by means of pin 317 and slot 319 to the closed position shown in FIG. 10. In addition to or in place of spring 221, a second inlet 216 in cylinder 213 may be provided. The inlet 216 is supplied with gas from cylinder 17 via tube 310 when spool valve 231 is not being actuated. The gas is supplied to the side of piston 217 opposite to the side supplied by inlet 215 and tube 311 so that member 315 and cradle 223 will be moved into the unoperated position.

As illustrated by FIG. 12, insert 225 is inserted into a recess formed for that purpose in cradle 223. The recess includes a horizontally extending portion 333 and a portion 355 angled downwardly. This forms the dispensing spout for the carbonated water and directs the carbonated water stream into a cup which is placed directly below the annular base 205 seen in FIG. 9. Positioning of the spout, i.e., its downward angle and relationship to the side of the cup are important for good mixing and $CO_2$ retention. The edge of portion 355 is visible in FIG. 10 within the annular ring 209.

In the cross-sectional view of FIG. 11, the manner in which the tubular member 225 rests within the cradle 223 is illustrated. In this cross section, the pin 317 within slot 319 is also visible.

The rotatable disk 209 contains a slot 351 which is adapted to engage a tab on the cap of the syrup package. The body of the syrup package contains another tab which engages with the cover portion 247. (This is described in more detail below). When a glass to be filled is lifted up against the actuator 233 of FIG. 12 and also seen in FIG. 14, it presses against the stem 235 operating valve 231 to admit gas to the cylinder 213. The gas in cylinder 213 moves the piston 217 which cooperates with piston rod 313 to move the slide member 315 to the left, causing a rotation of the annular ring 209 thereby starting to open the valve in the syrup package. Once the pin 317 reaches the other end of the slot 319, it also begins to move the cradle 223. The end of the tubular insert 225 prior to movement is sealingly abutting against the shuttle member 121. Thus, when the cradle 223 begins to move, the tubular insert 225 forces shuttle member 121 to moved inwardly to bring the inlet 123 of shuttle member 121 beneath the outlet 137 to cause a flow of carbonated water through the tubular rubber insert 225. Tubular insert 225 creates a seal with the shuttle outlet 125 to prevent leakage (see FIGS. 6, 7, 8). When the pressure on the actuator 233 is released, the force of the biasing spring 221 moves the slide member 315 to the right, the gas in the cylinder 213 now being vented. As noted above this return can also be done pneumatically or with air pressure instead of or in addition to the spring. This begins immediately to close the valve in the package by rotating the annular ring 209 and as the pin 317 reaches the right hand side of the slot 319, returns the cradle 223 to the position shown in FIG. 10. The end of the rubber insert 225 and its location with respect to the point where the carbonator is inserted is visible in FIG. 3.

Figure 14:
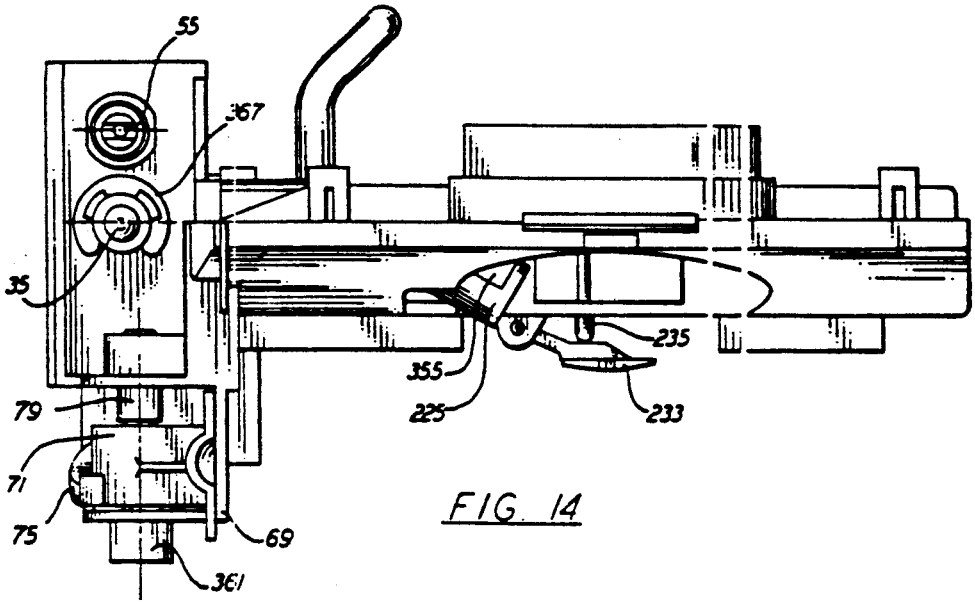
FIGS. 14 and 15 are views showing additional details of the actuator mechanism.
Figure 15:
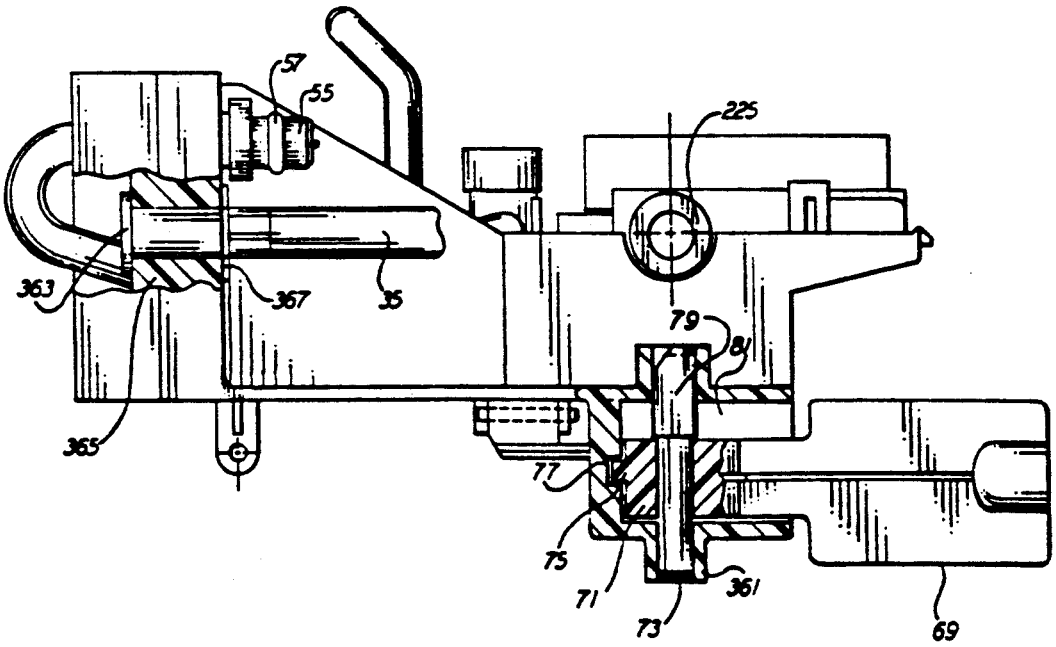

FIGS. 14 and 15 show some additional details of the actuator mechanism and the carbonator locking assembly. The arm 69 and cylindrical member 71 are visible as is the cam 75 and the cam slot 77. As illustrated, a central shaft 73 is supported in a bearing formed within a downwardly extending cylindrical member 361 having an appropriate bore therethrough to permit rotation therein. Mounted to the top of the shaft 73 is the stop member 79. Member 79 moves up through the opening 81 so as to lock against the carbonator when the handle 69 is rotated to lock the carbonator in place. Also shown is the alignment pin 35 and the fitting 55 with its O-ring 57. As illustrated, the alignment pin can have a head 363 and be inserted through wall 365 and held in place with a spring clip retainer 367. Also visible in the view of FIG. 15 is the end of the tubular insert 225 which abuts against and seals to the end of shuttle member 121 in the carbonator connecting assembly 33 and acts to open shuttle member 121 therein in the manner described above.

Figure 16:
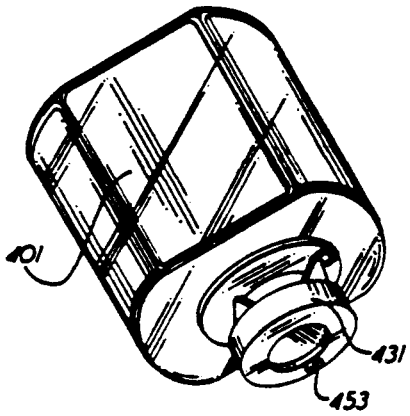
FIG. 16 is a perspective view of the syrup package of the present invention.
Figure 17:
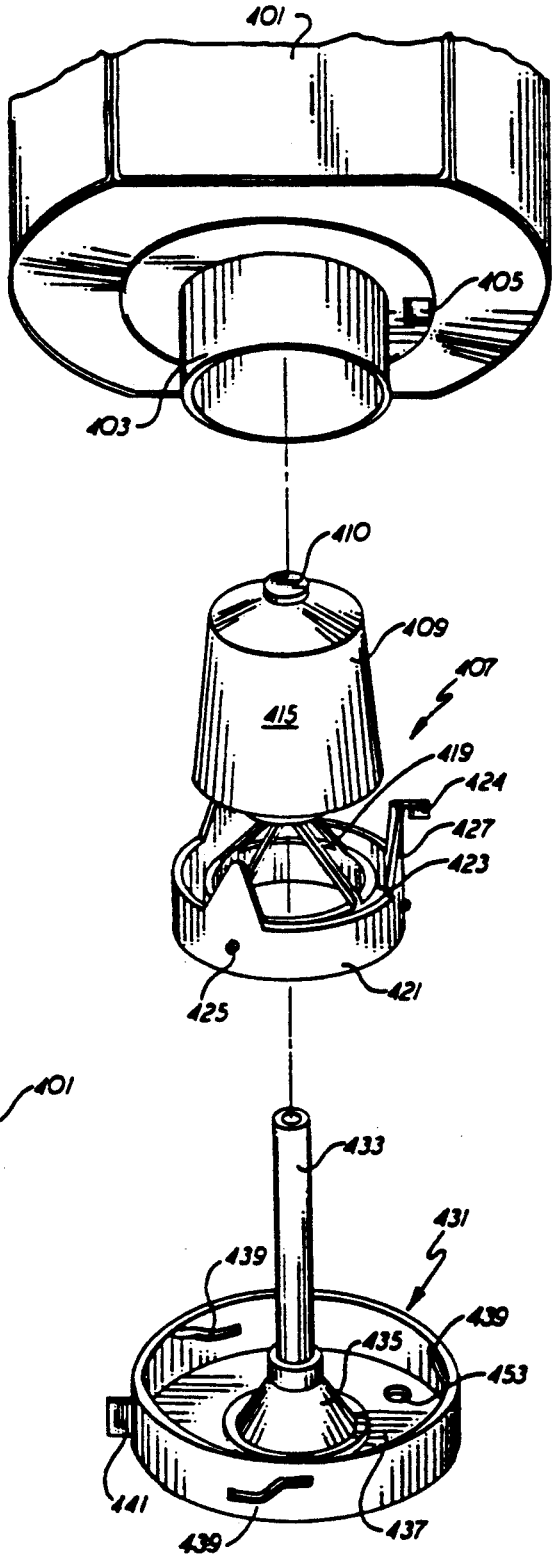
FIG. 17 is an exploded view of the parts of the package of FIG. 16.
Figure 18:
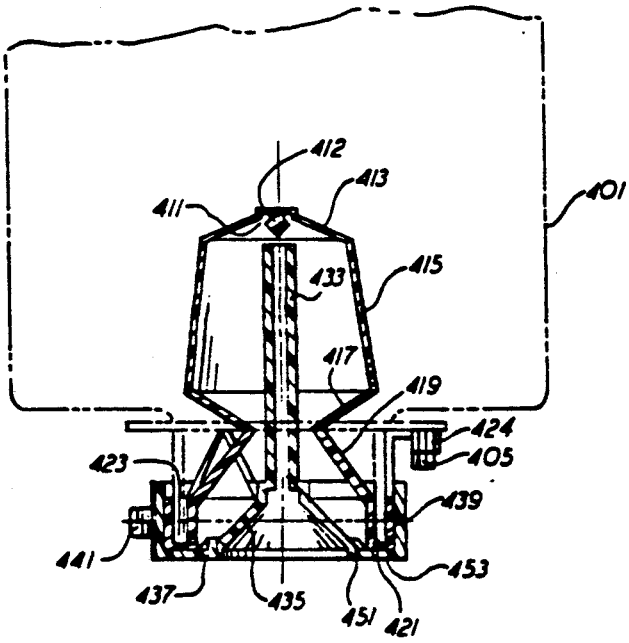
FIG. 18 is a cross-sectional view through the package of FIG. 16.

FIGS. 16–18 illustrate the syrup package of the present invention. In the illustrated embodiment the syrup package comprises three molded parts. The first of these is a body or container having a bottom, side walls and a top with a neck 403. At the base of a neck is a tab 405. The second part is an insert 407. The insert comprises a compensating chamber 409, at the top of which there is formed a cylindrical portion 410 which, as can be seen from the cross section of FIG. 18, forms a recess 411. Inside the recess is a conical plug 412 having an arrowhead cross section. Extending from this cylindrical portion is a downwardly conically extending portion 413 and then a another conical portion 415 extending slightly outwardly. Following this is another conical portion 417, but now extending inwardly and forming a baffle. This rests on a plurality of legs 419, which extend down to a portion of annular shape 421 having a U-shaped cross section. Within this portion 421 there is, thus, formed an annular recess 423. As illustrated by the cross section of FIG. 18, the annular cavity 423 receives the neck 403 of the container 401. On the outside wall of portion 421 are formed three projections 425. There is also provided an axially upwardly projecting part 427 on the end of which there is a tab 424 projecting radially outwardly. During assembly, the tab 424 of portion 421 is brought into abutment with the tab 405 at the base of the neck 403 and the two parts fastened together by gluing, welding, mechanical locking, etc.

The final part of the syrup package is a cap-like member 431, having an air inlet tube 433 extending upwardly therefrom. The air inlet tube terminates in a conical portion 435 at the top 437 of the cap 431. In the closed position shown, the top of the tube 433 seals externally against the recess 411 and internally against the arrowshaped conical plug 412 at the top of the compensating chamber 409. Formed in the cap 431 are three cam slots 439. These engage with the projections 425 on portion 421. Also formed in the cap 431 is a tab 441.

As previously discussed, the tab 441 will engage in the slot 351 in the annular ring 209 shown in FIGS. 10 and 12 for example. The tabs 405 and 429 will engage in an appropriate slot 352 in the cover 247 shown in FIG. 9 so that the container is held fixed while the cap 431 can rotate. As the cap 431 rotates, the tube 433 is moved away from the recess 411 and the arrowshaped conical plug 412 to permit a flow of air into the container. At the same time, the cap 431 is moved away from the insert 407 and a seal formed at point 451 between these two members is broken permitting the flow of syrup through an opening 453 in the cap 431. The operation of this type of package is described in detail in my previous application Ser. No. 310,488; and more specifically in Ser. No. 508,559.

Figure 19:
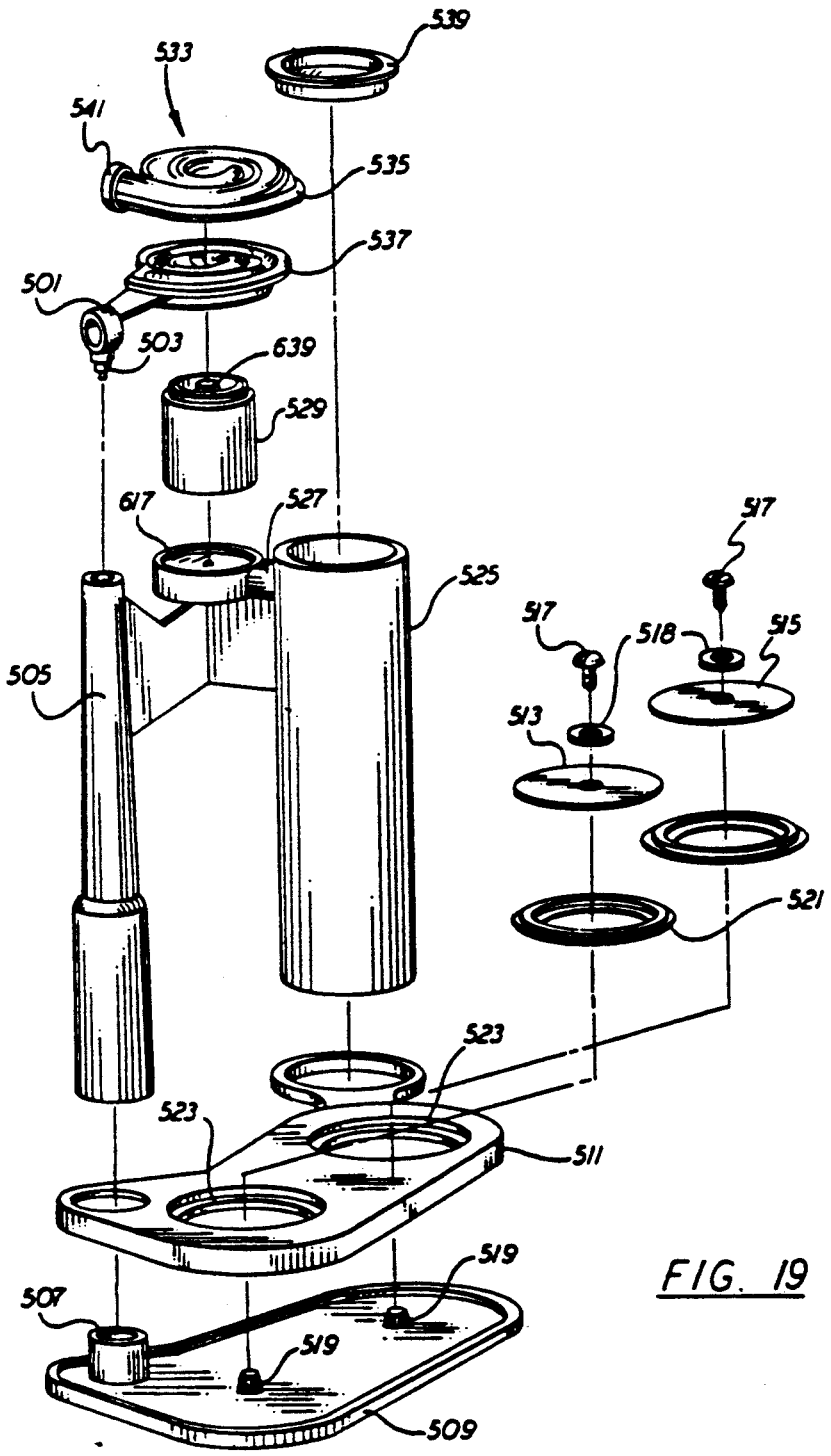
FIG. 19 is an exploded view of the assembly inserted inside the carbonator.
Figure 19B:
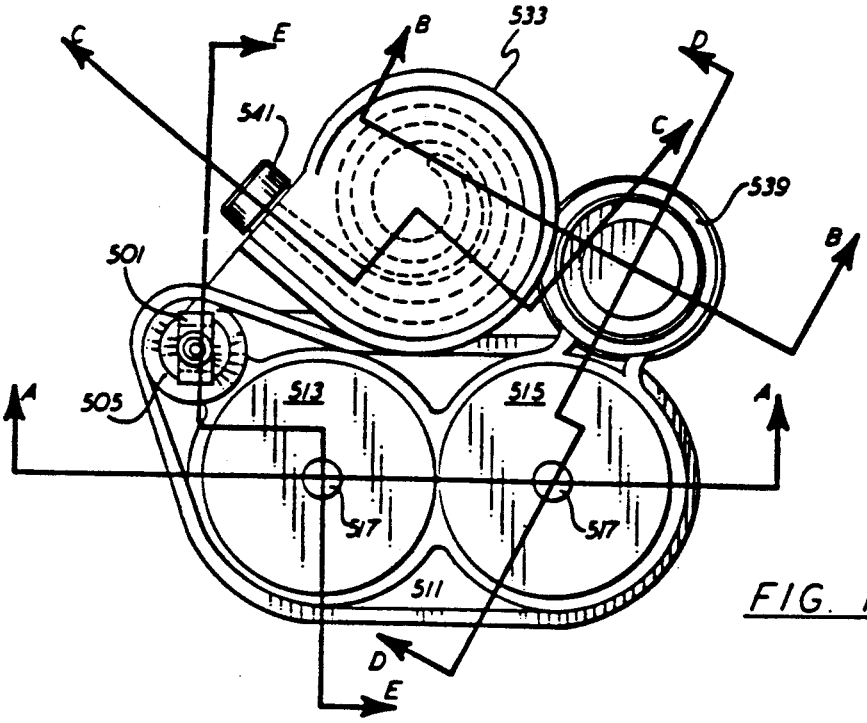
FIG. 19B is a plan view of this assembly.
Figure 19A:
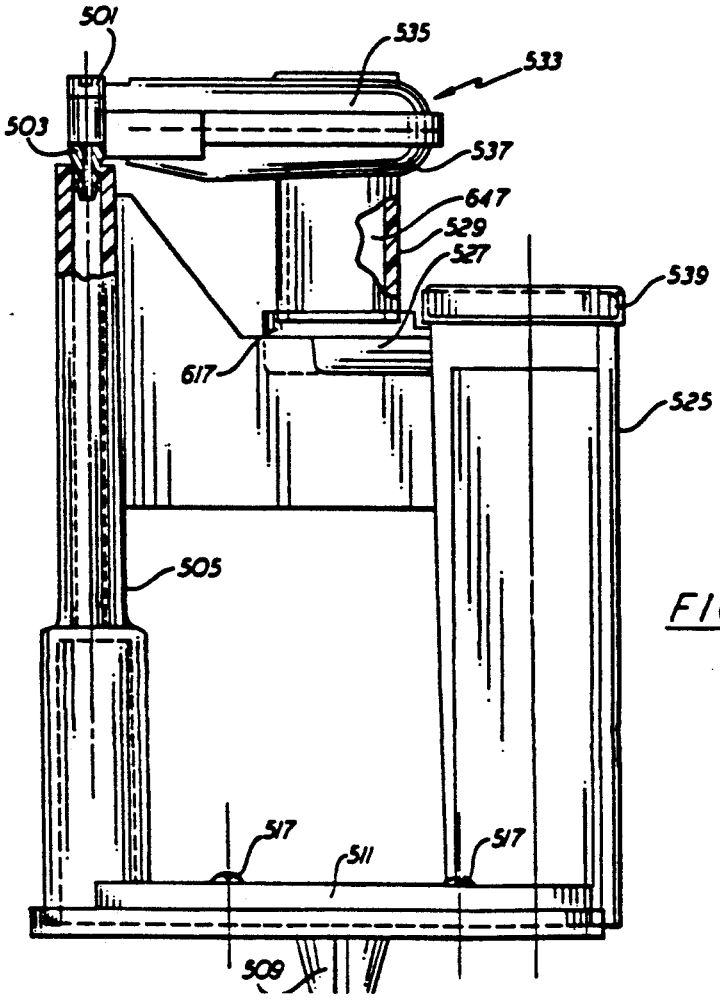
FIG. 19A is an elevation view of this assembly partially in cross section.

Referring to FIGS. 4 and 5, it was noted that there were fittings 111 and 109 which couple, respectively, with a gas outlet 65 of FIG. 4 and a water inlet 67 of FIG. 4. As described in connection with FIG. 5, these two fittings pass through openings 107 and 105 in the stainless steel carbonator tank 103. FIG. 19 is an exploded view of the assembly within the carbonator with which these two fittings 111 and 109 mate. FIGS. 19A and 19B are plan and elevation views of this assembly. The gas inlet 109 is coupled to a fitting 501 which is in the nature of an elbow fitting. The carbon dioxide is coupled through an outlet 503 therefrom into a tubular member 505 mounted to a cylindrical flange 507 on a base member 509. Contained within the base portion of the tubular, member 505 is a slow-feed valve of the type described in U.S. application Ser. No. 550,455. A cover 511 is placed over and sealed to the base 509. Gas flows between the base and cover and out through two diffusers 513 and 515. The diffusers are held in place by gasketed bolts 517 which thread into threaded bosses 519 formed in the base 509 with gaskets 521 interposed between the diffusers 513 and 515 and the cover 511 which has provided therein openings 523 for that purpose. The bolts 517 are provided with gaskets 518 to ensure that no gas leaks around the bolts. The diffusers are disclosed in more detail in application Ser. No. 393,299.

Figure 21:
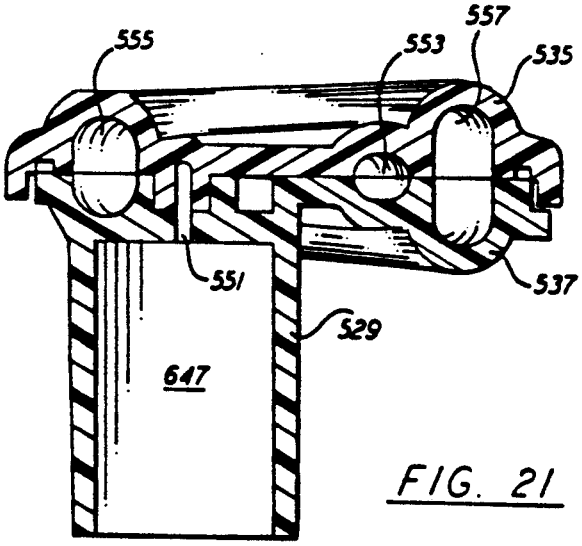
FIG. 21 is a first cross section through the expansion chamber of FIG. 20 taken along the lines 21—21.

The carbonated water within the tank flows out through a resin bed assembly 525, the outlet 527 of which is coupled into an anti-surge valve assembly which is inserted into a chamber 647 formed within member 529. Resin bed assembly 525 is shown as having a sealed lid 539 to permit inserting new charges of resin as the old resin is used up. The outlet 639 of the anti-surge valve is positioned adjacent to the inlet 551 (see FIG. 21) of an expansion chamber 533 made up of a top half 535 and a bottom half 537 onto which is also molded the gas inlet fitting 501. Preferably all of these parts are of molded plastic and sealingly assembled to each other in the manner indicated. The expansion chamber 535 terminates in an outlet 541 which couples with the fitting 111 of FIG. 5.

Figure 20:
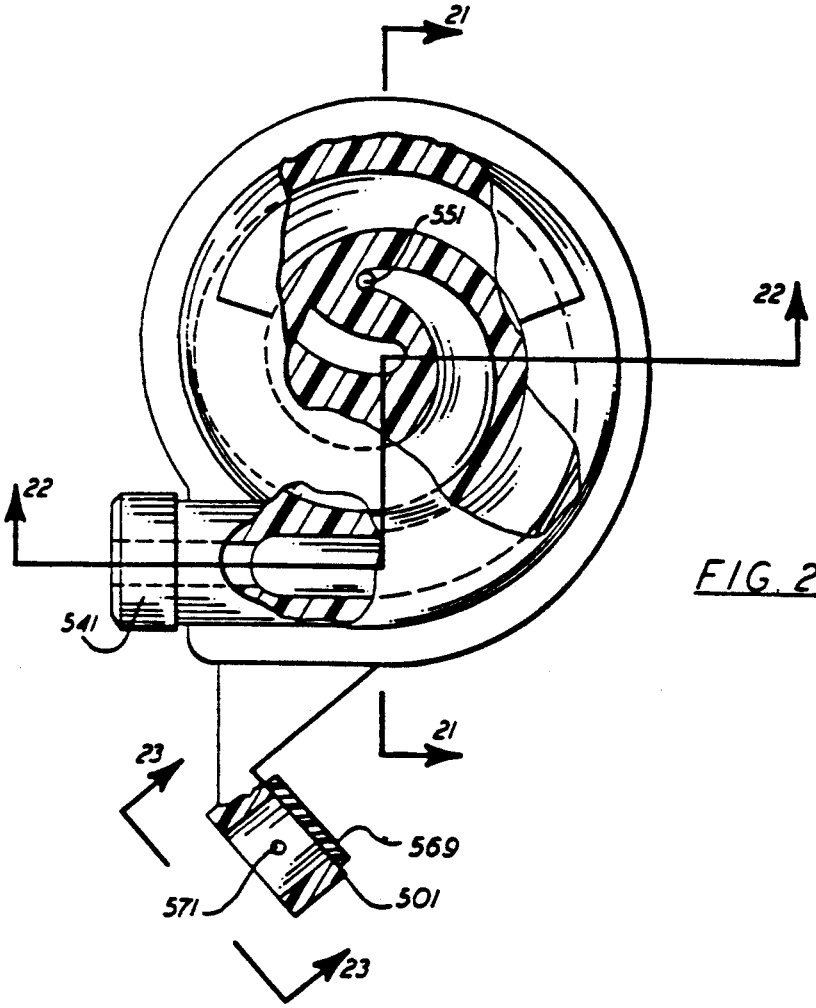
FIG. 20 is a plan view partially in cross section of the expansion chamber of FIG. 19.
Figure 23:
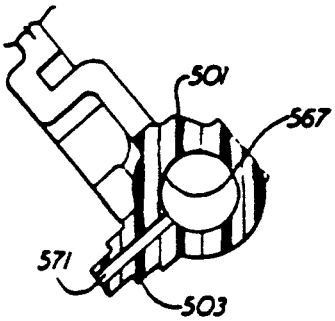
FIG. 23 is a cross section along the lines 23—23 of FIG. 20.
Figure 24:
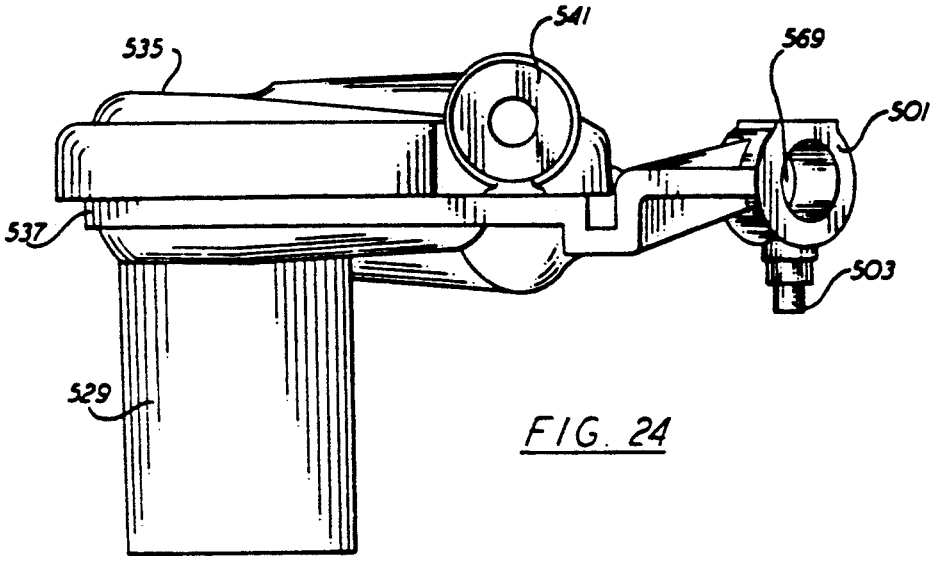
FIG. 24 is an elevation view of the expansion chamber.

The nature of the parts 535 and 537 can be better seen with reference to FIGS. 20–26. Referring to FIGS. 20 and 24, the general nature of the expansion chamber is seen. It has a generally spiral shape beginning at an inlet 551. The chamber gradually expands in size as it spirals around, finally reaching the outlet 541. In the cross section of FIG. 21, the inlet 551 is seen which then expands to the size 553 after 180 degrees, to size 555 after another 180 degrees, and to size 557 after another 180 degrees, which is the size being closest to the size at the outlet 541.

Figure 22:
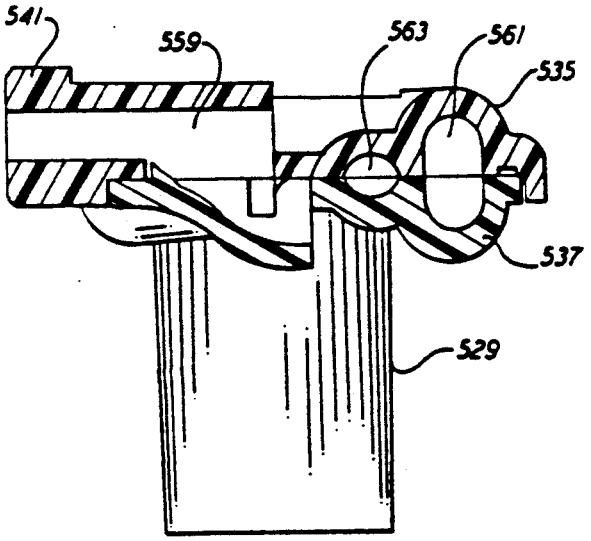
FIG. 22 is a cross section along the lines 22—22 of FIG. 20.
Figure 25:
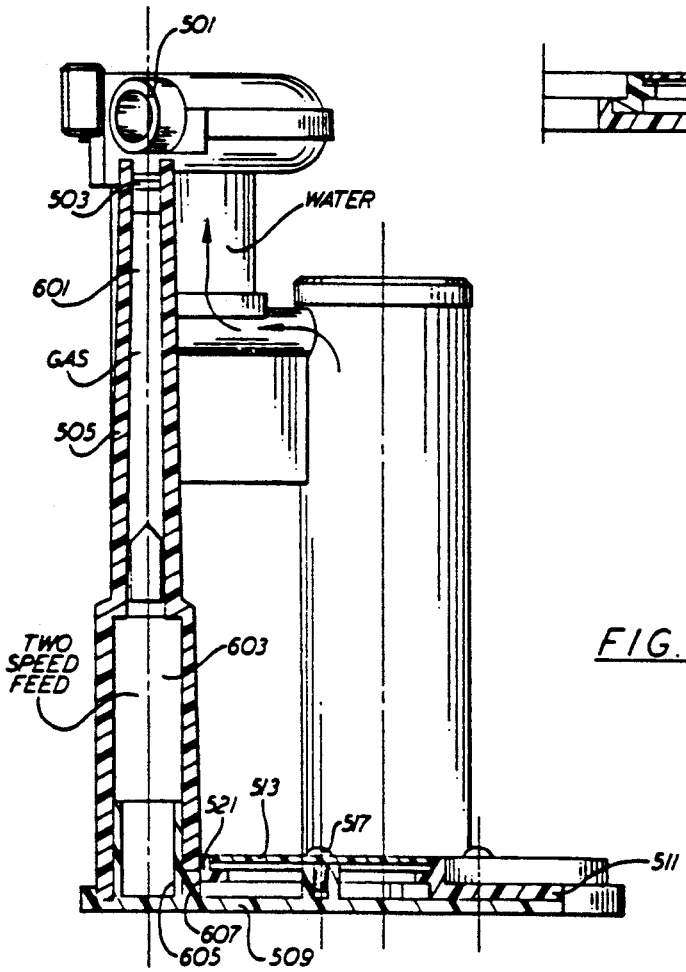
FIG. 25 is a partial cross section through the feed line and diffuser assembly within the carbonator.
Figure 29:
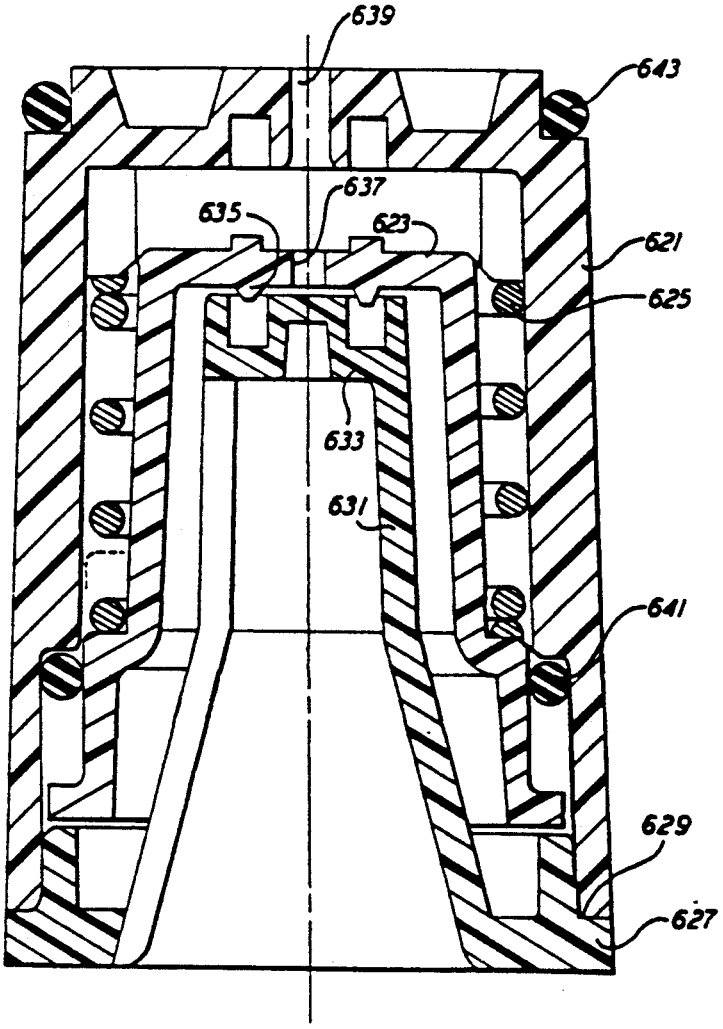
FIG. 29 is a cross section of the anti-surge valve of the present invention.

The cross section of FIG. 22 shows the outlet fitting 541 and outlet bore 559 and also portions 561 and 563 of the expanding chamber. Each of FIGS. 21 and 22 also shows the member 529 which forms the chamber 647 into which the anti-surge valve, to be described below in connection with FIG. 29, is inserted. FIGS. 20, 23 and 24 also show the construction of the inlet 501 for gas.

Figure 27:
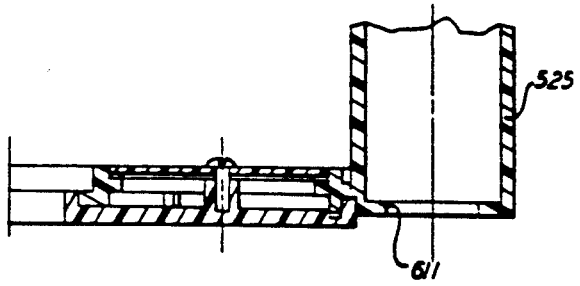
FIGS. 26 and 27 are cross-sectional views of portions of the diffuser assembly and resin bed.
Figure 26:
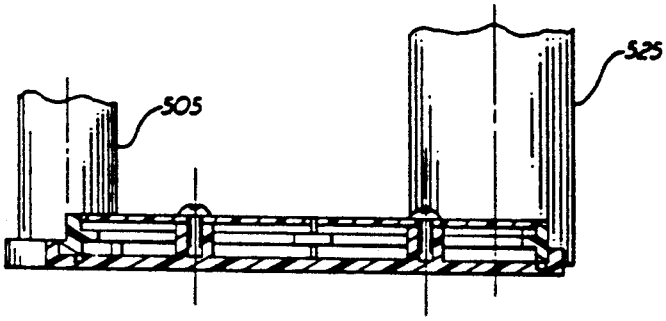
Figure 28:
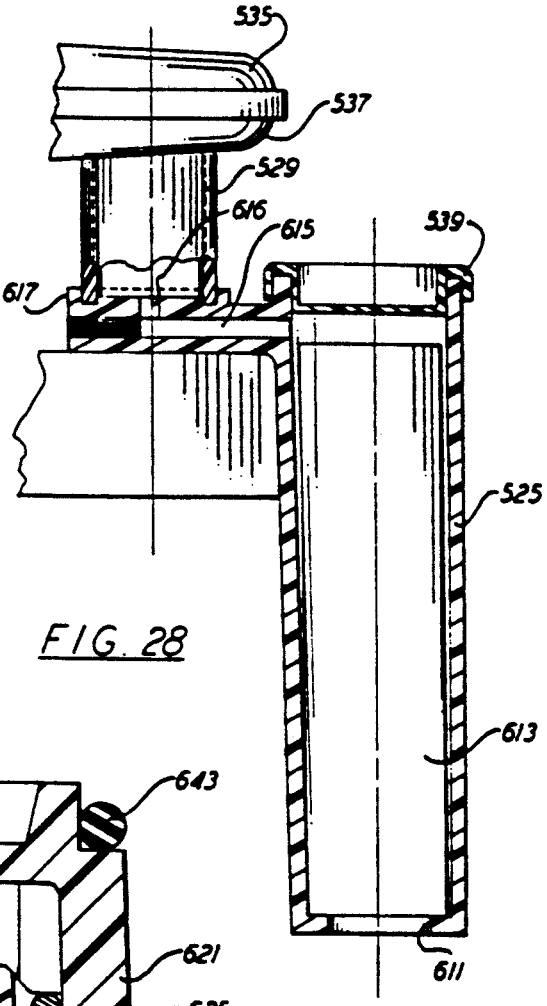
FIG. 28 is a cross section through the resin bed showing its connection to the chamber containing the anti-surge valve.

Gas flowing into the inlet 501, i.e., into its bore 567 which is closed off on the opposite side by a disk 569, seen in FIG. 20, then flows through a hole 571 into the outlet fitting 503 and then into the tubular member 505 described above. Incoming gas flows through the passage 601 in tubular member 505 seen in FIG. 25. At the base of member 505 the slow-feed or two-speed feed valve assembly 603 is installed. Gas flows out of the bottom of this assembly through openings 605 and 607 into the space between base 509 and lid 511. It flows out of the diffusers 513 and 515 held in place by gasketed screws 517 with gaskets 521 interposed between the cover 511 and the diffusers 513 and 515 seen in FIG. 19. In the cross section of FIG. 27, the inlet 611 in the resin bed can be seen along with a further view of the diffuser assembly. Another view showing the diffuser assembly and the resin bed container 525 is shown in FIG. 26. Referring to FIG. 28, the resin bed assembly 525 can be seen in more detail. Inserted sealingly within the resin bed assembly is a cartridge 613 containing beads of resin for filtering and deionizing the water. Water flows through the resin bed 613 to the top thereof and then out of an outlet passage 615. This passage extends radially to an axial passage 616 in a base portion 617 of the member 529 which contains the anti-surge valve sealingly inserted therein. Member 529 in turn is attached to part 537 in the manner described above.

The anti-surge valve itself is illustrated in FIG. 29. It includes a main body member 621. Retained within the body 621 is a valve member 623, which is biased downwardly by a spring 625. An insert 627 inserted into the open end 629 of the body 621 acts as a stop limiting the axial motion of the valve member 623. Extending axially inwardly from this cover 627 are a plurality of legs 631 on the ends of which is formed an annular valve seat 633. Valve seat 633 mates with a sealing ring 635 of triangular cross section formed on the valve member 623. The base of valve member 623 in the center of the sealing ring 635 contains a bore 637. The axial inner end of the body 621 contains a bore 639. An O-ring seal 641 is provided between the valve member 623 and the body 621. A further O-ring seal 643 is provided at the axial inner end of the body 621 and, referring to FIG. 21, seals the body to the wall of the chamber 647 formed by the member 529.

When the anti-surge valve of FIG. 29 is inserted into the chamber 647, the bore 639 is aligned with the inlet of opening 551, these two elements being of essentially the same diameter so that there is a smooth flow therebetween to avoid loss of carbonation. The purpose of the anti-surge valve TM :s to prevent surging and spitting when the carbonated water valve (i.e., the shuttle valve assembly) is first opened. The pressure within the carbonator is, for example, 50 psi. This pressure is reduced to atmosphere by the time the carbonated water is discharged from the outlet spout. It is the purpose of the spiral expansion chamber to gradually expand the water flow to gradually reduce this pressure so that a gradual reduction takes place without the loss of carbonation. In addition, a smooth flow is assured since sharp edges will break loose the carbon dioxide bubbles, as will any turbulence. However, when the shuttle valve assembly is closed, in the absence of an anti-surge valve, pressure builds up within the expansion chamber. The anti-surge valve prevents excessive pressure build up by closing when the sum of the pressure in the expansion chamber and the pressure of the biasing spring, typically 30 psi, equals the pressure inside the carbonator. In this manner, a reduced pressure, e.g., 20 psi, is maintained in the expansion chamber and surge problems are reduced. Once sufficient pressure builds up in the expansion chamber, that pressure plus the spring pressure pushes the valve member 623 downward such that the ring seal 635 seats against the valve seal 633, preventing further pressure build up. Once the shuttle valve assembly is opened, the pressure within the expansion chamber and hence above valve member 623 reduces allowing the pressure in the carbonator to move valve 623 off its seat and flow begins to occur through outlets 637 and 639. Water then flows through the inlet 551, through the spiral expansion chamber of FIG. 22 to the outlet 541.

Figure 31:
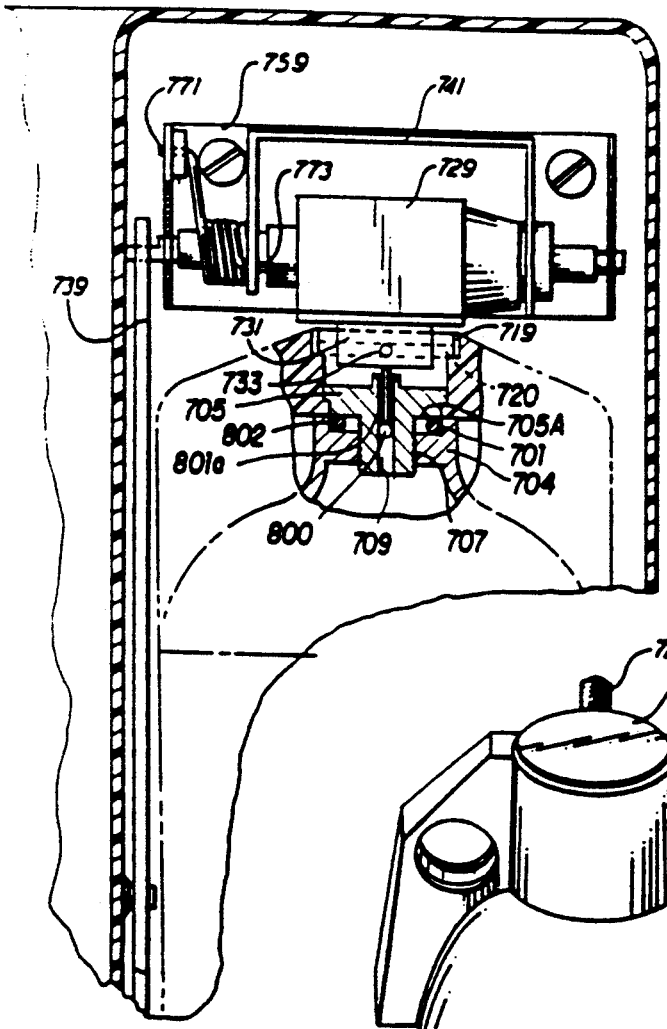
FIG. 31 is an elevation view partially in cross section showing the manner in which the $CO_2$ assembly is attached to a probe fitting in which is incorporated a regulator and also shows part of the weighing mechanism.
Figure 32:
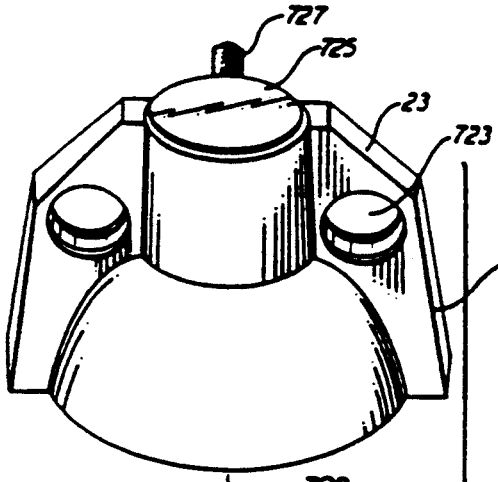
FIG. 32 is a perspective view showing the cylindrical member which permits attachment to the probe fitting of FIG. 31.
Figure 32:
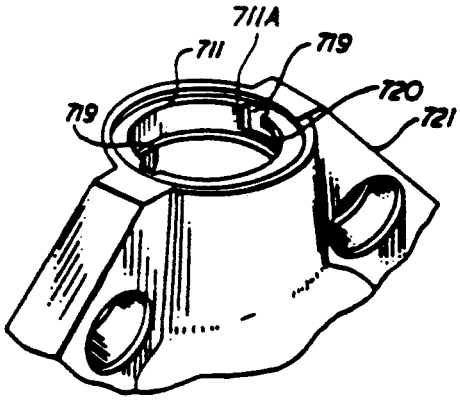
Figure 30:
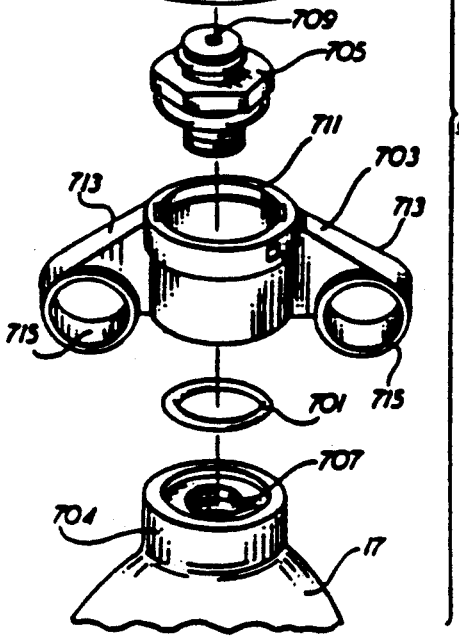
FIG. 30 is an exploded view of the elements attached to the top of the $CO_2$ cylinder.
Figure 31A:
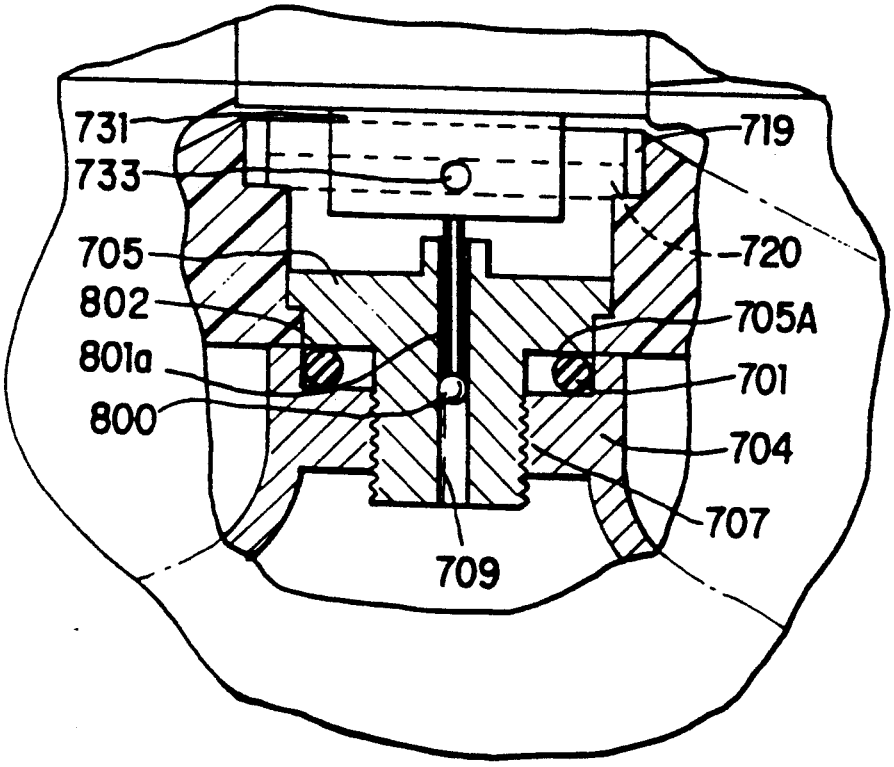

FIGS. 30–32 illustrate the cover assembly for the carbon dioxide cylinder 17 and its connection to a regulator which also acts as a weighing mechanism. Referring to FIG. 30, over the end of the gas cylinder 17 there is placed first an O-ring seal 701, then a member 703 which has an inner washer-like portion shown as 802 in FIG. 31 overlying the neck section 704 of cylinder 17, and is held in place by a flange 705A on threaded fitting 705, threaded into the threads 707 within the neck section of the cylinder 17. The fitting 705 contains a check valve shown shematically as 800 in FIG. 31 which is operated when an appropriately sized pin or probe, shown schematically as 801 in FIG. 31 and in cross-section as 801*a* in the enlarged view of FIG. 31A is inserted into its opening 709. Member 703 contains a central cylindrical portion 711 with two arms 713 at the ends of which rings 715 are formed as finger grips. As best seen from FIG. 32, on the inside of the cylindrical portion 711 are formed two diametrically opposed axially extending slots 719 which lead to horizontal circumferentially extending locking slots 720. These are also shown in FIG. 31. A cover 23 is snapped over the member 703 to give the cylinder the finished appearance illustrated in FIG. 1. The cover is shaped so as to enclose the top of the cylinder and the member 703 and includes side parts 721 with openings 723 which align with the openings 715. These openings permit a finger grip for ease in handling of the cylinder. The cover 23 contains a tear-away top portion 725 with a tab 727 provided to tear off the cover to permit ease of access to the fitting 705. The handles 713 and 721 also act as an alignment means. As can be seen from FIG. 32, the axial slots 719 are aligned with the handle 721. Thus, when inserting these on a regulator assembly 729 which has a mating fitting 731 with projections 733 thereon, for engaging in the slots 719 and 720, the handles can be used for alignment purposes. The user simply lines up the handles with the pins 733 and then rotates the handles 721 until they are in a predetermined position in which the cylinder is locked in place against the fitting 731. The fitting 731 includes the hollow probe 801 schematically shown in FIG. 31 which fits into and seals within the opening 709 and opens the valve 800 therein to permit the flow of carbon dioxide through the regulator and into the rest of the system. However, the probe is much thinner than previously employed to permit manual connection of the cylinder 17 to the fitting 731.

Figure 33:
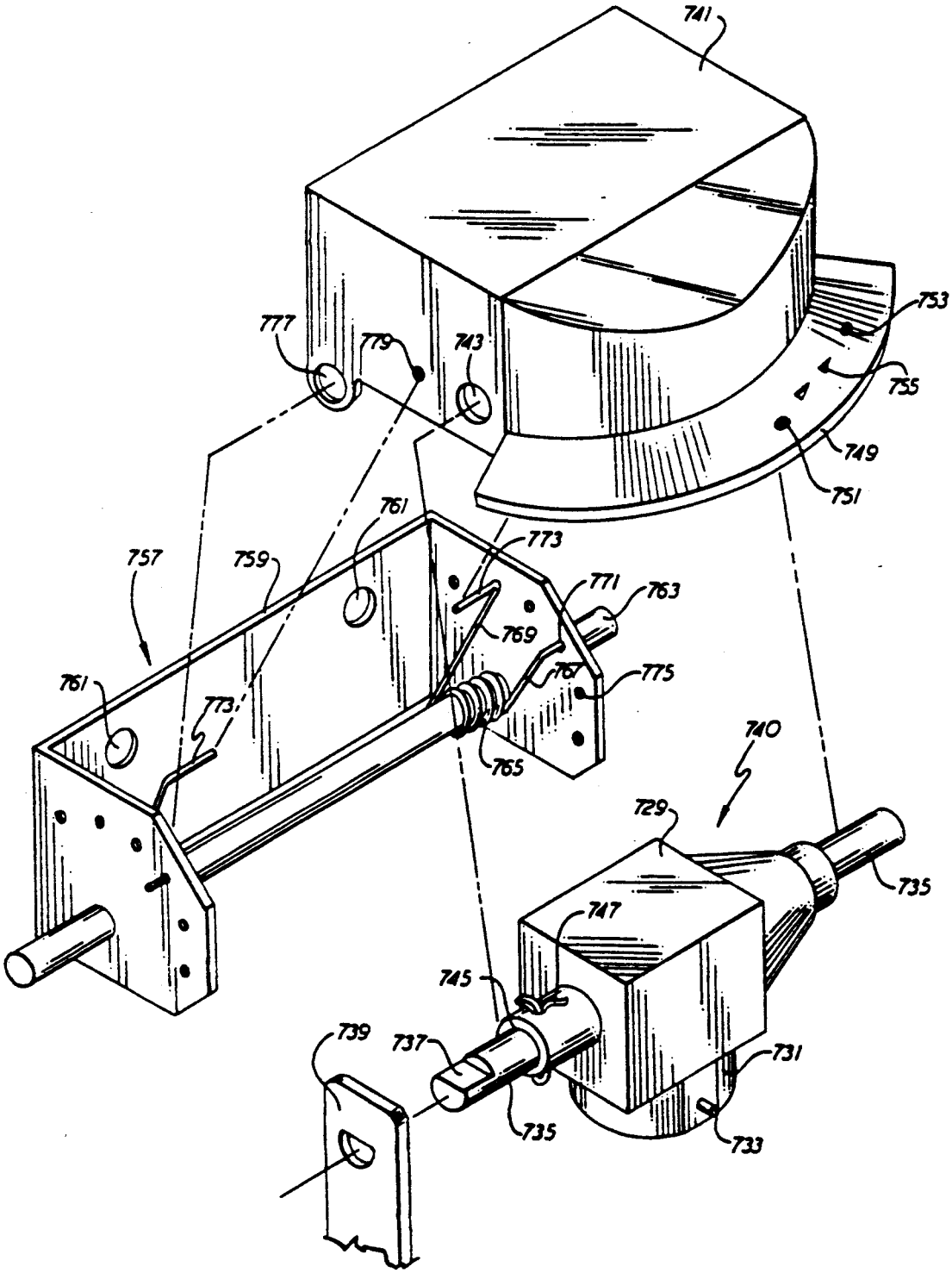
FIG. 33 is an exploded view of the weighing mechanism of the present invention.

The regulator 729 is also shown in FIG. 33 which is an exploded view of the regulator and weighing assembly. The fitting 731 of the regulator 729 with its pins 733 is visible at the bottom of the Figure. A shaft 735 extends out from both ends of the regulator. Shaft 735 on the left hand side contains a flat 737. A member 739 to be described in more detail below is placed over this end of the shaft 735. The whole assembly, generally indicated as 740 is inserted into a hood 741 containing holes 743 on each side thereof for accepting the shaft 735. The shaft 735 is held in place in a cylindrical recess of a collar 745 attached to the regulator 729 by means of a cotter pin 747. Thus, after the regulator 729 is inserted in the hood 741, the cylindrical recess of collar 745 is aligned with holes 743 and shaft 735 is inserted through the shaft is then secured in place to collar 745 745 with cotter pins 747. Thereafter the member 739 can be placed over the end of the shaft 735. The hood 741 has a brim 749 containing thereon indicia 751 and 753 along with arrows 755. The indicia indicate to the user the proper alignment for the handles 721 in the position where the bottle is inserted and the position where it is locked in place. The hood 741 is held by an assembly 757. This includes a U-shaped bracket 759 having holes 761 in its base for mounting to the machine. Extending through the two legs of this U-shaped bracket 759 is a shaft 763. At each end of the shaft is a spring 765. This is a coil spring containing arms 767 and 769 each of which are bent at their ends so as to have a portion parallel to the axis of the spring. The arm 767 contains an axially extending portion 771. Portion 771 engages in one of a plurality of holes 775 in the arm of the bracket 759. The bracket 759 encloses the rear portion of the hood 741 with the shaft 763 extending through the opening 777. The inwardly extending portion 773 of spring arm 769 engages in holes 779. Thus, hood 741 rotates on shaft 763 and is biased upwardly by spring 765.

Figure 34:
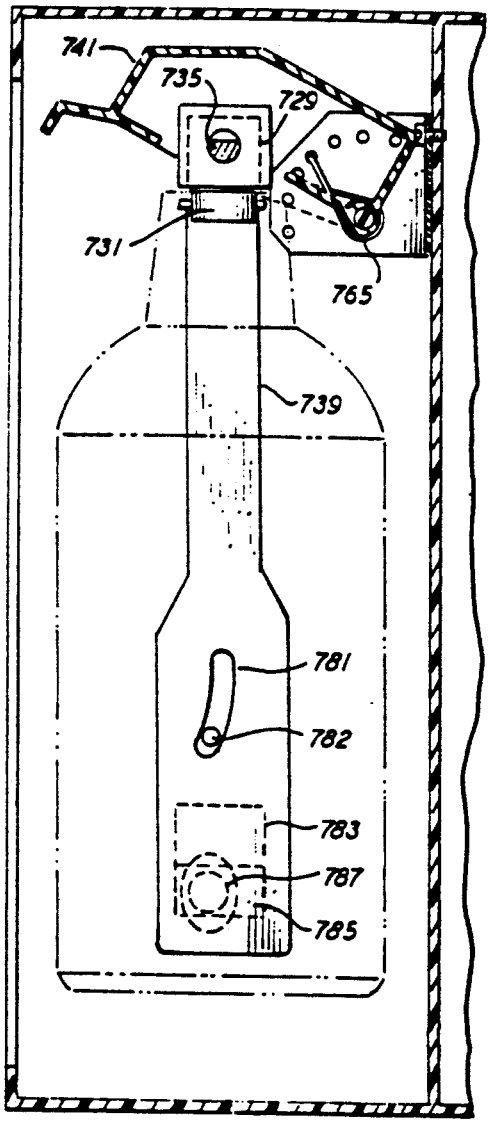
FIGS. 34 and 35 are elevation views, partially in cross section and partially in phantom showing the operation of the weighing mechanism, FIG. 34 showing the weight mechanism with an empty cylinder and FIG. 35 showing the weighing mechanism with a full cylinder.
Figure 35:
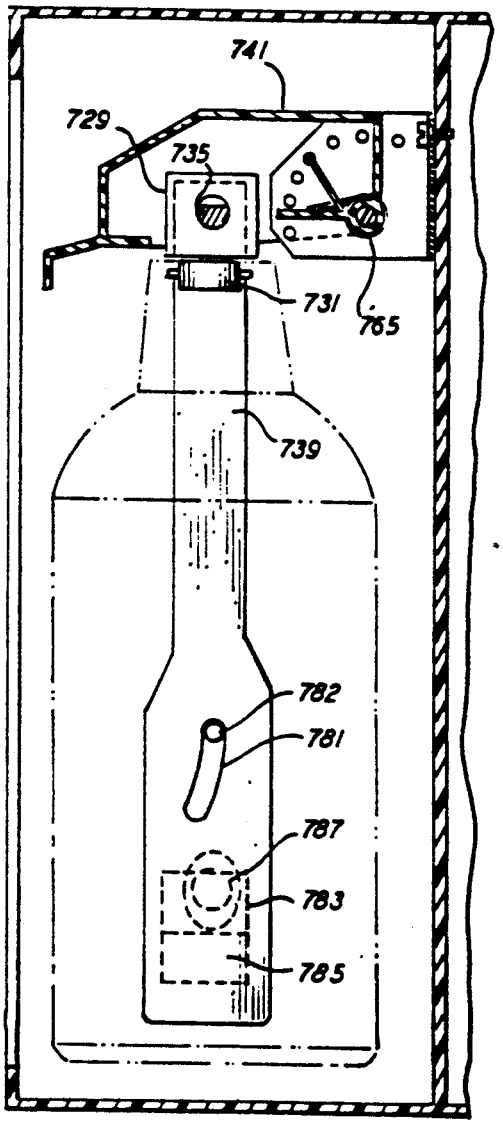
Figure 36:
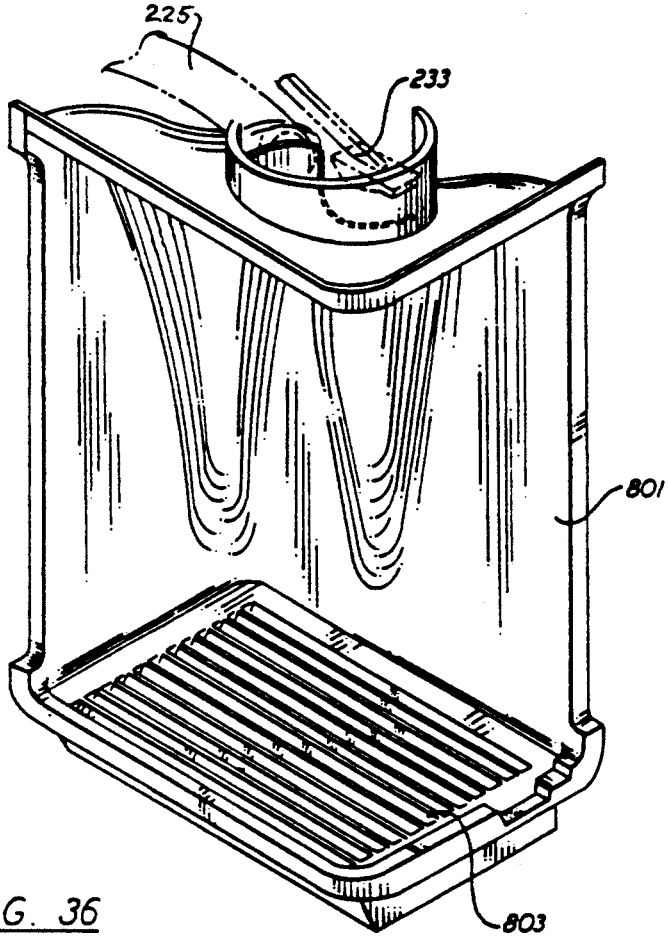
FIG. 36 is a perspective view showing one manner of maintaining a tangential relationship between the dispensing spout and a glass or cup irrespect of the diameter of the cup.
Figure 37A:
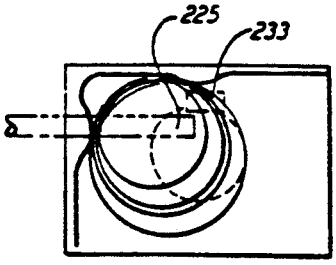
FIGS. 37*a–c* show how this device maintains this relationship for different sizes of cups.
Figure 37B:
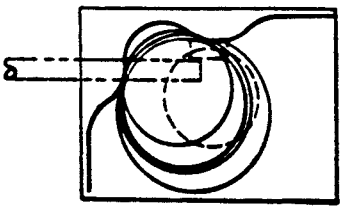
Figure 37C:
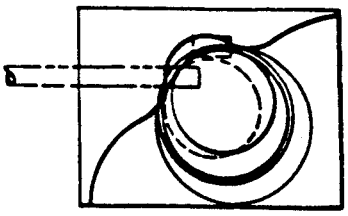

FIGS. 34 and 35 illustrate manner in which the weighing mechanism operates. The previously mentioned member 739 comprises a planar member containing an arcuate slot 781 therein. The slot 781 slidably engages a pin 782 provided on the inside of one of the walls of the cylinder compartment adjacent to the planar member. Its purpose is to maintain the axis of the fitting 731 vertical irrespective of the rotation of the hood 741. FIG. 34 shows the hood 741 rotated upwardly, corresponding to an empty bottle or no bottle in place. FIG. 35 illustrates the hood 741 rotated downwardly with a full bottle in place. It will be recognized, that the locus of shaft 735 moving between the positions of FIGS. 34 and 35 will exhibit curved motion and, were it not for the slot 781 and pin 782 and the rigid connection of the member 739 to the shaft 735, which in turn is rigidly connected to the regulator 729 and thus to the fitting 731, rotation of the regulator 729 and fitting 731 would take place. It is important that the axis of the fitting 731 be maintained vertical so that $CO_2$ bottles can be easily. removed and inserted. The springs 765, thus, tend to bias the cover 741 upwardly into the position shown in FIG. 34. The weight of a full $CO_2$ cylinder acts against this biasing action to bring the cover downward to the position shown in FIG. 35.

The member 739 performs a second function, the function of an indicator. At the bottom of the member 739 are painted two areas 783 and 785. Area 783 is painted green, for example, and area 785 is painted red. A viewing window 787 is provided in the drink dispenser housing through which the painted areas 783 and 785 can be observed. With a full bottle, one looks through the viewing window 787 and sees the green area 783. As the bottle begins to empty, the red area 785 begins to appear until, when all red, the bottle is essentially empty. Preferably, the biasing force of the springs 765 is such that they operate only over the last ten percent of carbon dioxide in the bottle. That is to say, only when the bottle is, for example, 10 percent full will the bottle become light enough so that the spring begins to move the cover 741 upwardly. This gives a better indication at the end of supply than would a linear system which would be difficult to calibrate. The biasing force of the spring 765 may be charged as needed based on the users selection of the various holes 775 in bracket 759.

FIGS. 36 and 37*a–c* illustrate one means of maintaining a tangential relationship between the inside of the glass and the dispensing spout. Such a tangential relationship is desirable so that the carbonated water swirls around the glass in such a way as to mix the water and syrup but in such a way as to not lose its carbonation. Without such control, if, for example, the stream of water impinges directly on an opposing wall of the cup, this will cause a breakup of the bubbles of carbon dioxide and a loss of carbon dioxide and the drink will not taste as it should. Thus, there is provided a surface 801 with a compound curve. This is above the drip tray 803 in the area below the dispense head. The glass is lifted up and guided along the compound curve until it touches the actuator 233 causing actuation in the manner described above and a flow of water from the spout 225. As illustrated in FIG. 37, because of the compound curve, irrespective of the cup size, a flow of water that is more or less tangential to the inside surface of the cup will occur.

What is claimed is:

1. In a post mix drink dispenser including a source of diluent under pressure, a dispensing outlet having a cross section for dispensing said diluent and a dispensing valve between said dispensing outlet and said source, the improvement comprising, an expansion chamber having a curved path and being disposed between said source and said dispensing outlet and which has an inlet of narrow cross section and an outlet of a cross section sized similarly to said cross section of said dispensing outlet, the cross section of said expansion chamber gradually increasing between said inlet and said outlet.

2. Apparatus according to claim 1, wherein said expansion chamber follows a spiral path.

3. Apparatus according to claim 2 further comprising an anti-surge valve preceding the inlet to said expansion chamber to prevent a buildup of pressure therein when said dispensing valve is closed.

4. Apparatus according to claim 3, wherein said anti-surge valve comprises:

(a) a cup-shaped body having an outlet in its base;

(b) a valve member having an outlet disposed within said body;

(c) a valve seat member, said valve seat member fixed to said body;

(d) means acting between said body and said valve member to bias said valve member against said valve seat member to close the outlet in said valve member; and (e) means forming a seal between the outside of said valve member and inside of said body.

5. Apparatus according to claim 4 wherein said valve member is cup-shaped with its outlet in its base.

6. Apparatus according to claim 4, wherein the opening in said base of said body is the same size as the inlet to said expansion chamber and said base is in abutting relationship with said inlet with said base opening and expansion chamber inlet aligned.

7. Apparatus according to claim 5, wherein said source is pressurized to a first pressure and said valve is adapted to open at a pressure lower than said first pressure.

8. Apparatus according to claim 7, wherein said source comprises a carbonator tank and wherein said expansion chamber and anti-surge valve are disposed within said carbonator tank, said dispensing valve mounted to the outside of said tank and having an inlet coupled to a fitting extending through the wall of said tank to said expansion chamber.

9. Apparatus according to claim 8, wherein said dispensing valve comprises:

(a) valve body containing therein a bore open on one end and closed at the other, said inlet opening into said bore from the side thereof;

(b) a shuttle supported for movement in said bore, said shuttle having formed therein a passage with an axial outlet and radial inlet and having a sealing surface axially inward of said radial inlet;

(c) means biasing said shuttle axially outwardly such that said sealing surface and inlet to said bore are aligned;

(d) a seal surrounding said radial inlet and sealing against said sealing surface; and (e) stop means for limiting the axial outward movement of said shuttle, such that by pushing said shuttle inwardly, against said biasing means, said radial inlet can be aligned with said inlet opening to permit flow through said shuttle and out said outlet.

10. Apparatus according to claim 9, wherein said dispensing spout includes an extension of a cross section corresponding to the cross section of said shuttle and further including means to move said spout into axial contact with said shuttle and to move said shuttle to open said dispensing valve.

11. Apparatus according to claim 10, wherein said spout comprises:

a tubular member having an end thereof contacting said shuttle, said spout being bent downwardly for dispensing into a container; and means for sealing at said end.

12. Apparatus according to claim 11, wherein said shuttle comprises a cylindrical member with a flat portion on its top at the axial inner end thereof, said radial inlet formed in the axial outer part of said flat and the axial inner part of said flat forming said sealing surface.

13. Apparatus according to claim 12, and further including recess in the bottom of said shuttle to form at least one stop surface, a radial bore in said body intersecting said axial bore said radial bore being aligned with at least a portion of said slot; a projecting button in said radial bore cooperating with said, slot to form a stop cooperating with said at least one stop surface, and means biasing said button upwardly to aid in sealing said shuttle against said seal.

14. Apparatus according to claim 13, wherein said carbonator is a removable batch carbonator comprising a tank and a lid and further including a passage through said body and through the wall of said tank for supplying carbon dioxide to said carbonator and a check valve in said passage.

15. Apparatus according to claim 13, wherein said post mix dispenser is an in-home drink dispenser and includes:

(a) a compartment with walls for accepting said carbonator;

a carbon dioxide fitting mounted to a wall of said compartment said carbon dioxide inlet bore aligned with said fitting for sliding engagement therewith;

(c) said dispensing spout extending through a wall of said compartment such that, when said carbonator is slid onto said carbon dioxide fitting, said spout is aligned with said axial bore; and (d) means for locking said carbonator in place with said bore slid onto said fitting.

16. Apparatus according to claim 15, wherein said drink dispenser includes means for dispensing a concentrate including a concentrate valve and wherein said spout moving means are coupled to open said concentrate valve at the same time as said spout is moved to open said dispensing valve.

17. Apparatus according to claim 16, wherein said concentrate valve is located in a disposable concentrate package, said package comprising more than one part, said concentrate valve is operable by movement of concentrate one package par to another, said dispenser includes means for holding said package, and said spout moving means is adapted to act to move said parts relative to each other.

18. Apparatus according to claim 17, wherein said movable parts comprise a body of the package and a cap, rotation or said cap opening said concentrate valve and said means to hold include means to hold said body nd a disk rotatable therein engaging said cap, said spout moving means acting to rotate said disk.

19. Apparatus according to claim 18, wherein said spout moving means comprise a pneumatic actuator.

20. Apparatus according to claim 19, wherein said pneumatic actuator comprises a cylinder and piston, said piston having a rod extending therefrom and out of said cylinder; and a slide member on the end of said rod, said slide member engaging said cradle and said disk.

21. Apparatus according to claim 20, wherein said slide member contains a pin and said cradle a slot, said pin engaging in said slot, whereby, upon actuation, said pin will first move from one end of said slot to the other, while said disk is rotating before said cradle moves to open said dispensing valve.

22. Apparatus according to claim 20, wherein said actuating means further includes a valve for supplying as to said cylinder, and an actuator for operating said valve.

23. Apparatus according to claim 22 wherein said actuator is disposed with respect to a container into which carbonated water is to be dispensed from said spout, such that movement of said container into a position to receive carbonated water from said spout will move said actuator such as to operate said valve.

24. Apparatus according to claim 22, wherein said slide member is biased to a closed position by a spring, said valve venting said cylinder when not actuated.

25. Apparatus according to claim 22, and further including means for positioning said container such that carbonated water will be dispensed essentially tangentially to the inner surface thereof to reduce loss of carbonation during dispensing.

26. In a post mix drink dispenser including a source of concentrate; a concentrate valve; a carbonator tank containing diluent under pressure, a dispensing spout having an outlet for dispensing said diluent into a container and a dispensing valve between said dispensing outlet and said source, the improvement comprising:

(a) said dispensing valve mounted to the outlet of the carbonator tank and having an inlet coupled to a fitting extending through the wall of said tank; and (b) said dispensing valve comprising:

(i) valve body containing therein a bore open on one end and closed at the other, said tank fitting opening into said bore;

(ii) a shuttle supported for movement in said bore, said shuttle having formed therein a passage with an axial outlet and an inlet opening;

(iii) means biasing said shuttle axially outwardly;

(iv) stop means for limiting the axial outward movement of said shuttle, such that by pushing said shuttle inwardly, against said biasing means, said inlet can be coupled with said tank fitting to permit flow through said shuttle and out said outlet.

27. Apparatus according to claim 26, wherein said dispensing spout includes an extension of a cross section corresponding to the cross section of said shuttle and further including means to move said spout into sealing axial contact with said shuttle and to move said shuttle to open said valve.

28. Apparatus according to claim 27, wherein said spout comprises a tubular member having a flange on the end thereof contacting said shuttle said spout being bent downwardly for dispensing into a container and means at said flange for sealing said tubular member to said shuttle.

29. Apparatus according to claim 27, wherein said carbonator tank is a removable batch carbonator comprising a tank and a lid and further including a passage through said body and trough the wall of said tank for supplying carbon dioxide to said carbonator and a check valve in said passage.

30. Apparatus according to claim 29, wherein said postmix dispenser further includes:

(a) a compartment with walls for said carbonator tank;

(b) a carbon dioxide fitting mounted to a wall of said compartment, said carbon dioxide inlet bore aligned with said fitting for sliding engagement therewith;

(c) said dispensing spout extending through a wall of said compartment such that, when said carbonator is slid onto said carbon dioxide fitting, said spout is aligned with said axial bore; and (d) means for locking said carbonator in place with said bore slid onto said fitting.

31. Apparatus according to claim 30, wherein said spout moving means is coupled and arranged to open said concentrate valve at the same time as said spout is moved to open said dispensing valve.

32. Apparatus according to claim 31, wherein said concentrate valve is located in a disposable concentrate package, said package comprising more than one part, said concentrate valve is operable by movement of one package part relative to another, said dispenser includes means for holding said package, and said spout moving mean is adapted to act to move said parts relative to each other.

33. Apparatus according to claim 32, wherein said movable parts comprise a body of the package and a cap, rotation of said cap opening said concentrate valve and said means to hold include means to hold said body and a disk rotatable therein engaging said cap, said spout moving means acting to rotate said disk.

34. Apparatus according to claim 33, wherein said spout moving means comprise a pneumatic actuator.

35. Apparatus according to claim 34, wherein said pneumatic actuator comprises a cylinder and piston, said piston having a rod extending therefrom and out of said cylinder; and a slide member on the end of said rod, said slide member engaging said cradle and said disk.

36. Apparatus according to claim 35 wherein said slide member contains a pin and said cradle a slot, said pin engaging in said slot, whereby, upon actuation, said pin will first move from one end of said plot to the other, while said disk is rotating before said cradle moves to open said dispensing valve.

37. Apparatus according to claim 35, wherein said actuating means further includes a valve for supplying gas to said cylinder, and an actuator for operating said valve.

38. Apparatus according to claim 37 where said actuator disposed with respect to a container into which carbonated water is to be dispensed from said spout, such that movement of said container into a position to receive carbonated water from said spout will move said actuator such as to operate said valve.

39. Apparatus according to claim 35, and further including means for positioning said container such that carbonated water will be dispensed essentially tangentially to the inner surface thereof to reduce loss of carbonation during dispensing.

40. In a carbonated drink dispenser, a mating assembly for connecting a removable carbonation tank to said carbonated drink dispenser comprising:

a) a first assembly, i) being attached to said carbonating tank, and ii) having a cylindrical fitting, and a tapered bore; and b) a second assembly, i) being attached to said carbonated drink dispenser, and ii) having a projecting member adapted to mate with said tapered bore, a tubular valve adapted to mate with said cylindrical fitting, and having an opened state and a closed state, and a locking mechanism having an unlocked state and a locked state.

41. The mating assembly of claim 40 wherein said tubular valve further includes means for actuating said tubular valve to said opened state.

42. The mating assembly of claim 41 wherein said tubular valve is a Schrader type valve and said means for actuating is a pin at the tip of said Schrader type valve.

43. The mating assembly of claim 40 wherein said first assembly further comprises an outlet being fluidly coupled with said cylindrical fitting.

44. The mating assembly of claim 40 wherein said tubular valve includes an O-ring seal.

45. The mating assembly of claim 40 wherein when said carbonation tank is installed in said carbonated drink dispenser and said locking mechanism is in said locked state, said carbonation tank is positively held in position.

46. The mating assembly of claim 45 wherein a void is defined on a side of said first assembly and wherein said locking mechanism comprises:

i) a stop member adapted to engage said void when said locking mechanism is said locked state and said carbonation tank is installed in said carbonated drink dispenser, and to disengage said void when said locking mechanism is said unlocked state and said carbonation tank is installed in said carbonated drink dispenser; and ii) means for actuating stop element between a first position in which said locking mechanism is in said locked state and a second position in which said locking mechanism is in said unlocked state.

47. The mating assembly of claim 46 wherein a slot and a circular void are formed in said second assembly and wherein said means for actuating includes:

a shaft accommodated in said circular void;

a cylindrical member attached to said shaft and being coaxial with said shaft;

a member projecting from said cylindrical member, said member adapted to permit said cylinder and said shaft to be rotated; and a cam formed on said cylindrical member and engaging said slot.

* * * * *